US009585508B2

(12) United States Patent
Graneto, III

(10) Patent No.: US 9,585,508 B2
(45) Date of Patent: Mar. 7, 2017

(54) SYSTEMS AND METHODS FOR DEPLOYMENT OF CURTAINS

(71) Applicant: ICP Medical, LLC, St. Louis, MO (US)

(72) Inventor: Joseph A. Graneto, III, St. Charles, MO (US)

(73) Assignee: ICP Medical, LLC, St. Louis, MO (US)

( * ) Notice: Subject to any disclaimer, the term of this patent is extended or adjusted under 35 U.S.C. 154(b) by 75 days.

(21) Appl. No.: 14/502,124

(22) Filed: Sep. 30, 2014

(65) Prior Publication Data

US 2015/0136340 A1 May 21, 2015

Related U.S. Application Data

(63) Continuation of application No. 13/284,062, filed on Oct. 28, 2011, now Pat. No. 8,869,869, which is a continuation-in-part of application No. 12/773,511, filed on May 4, 2010, now Pat. No. 8,479,800, which is a continuation-in-part of application No. 12/396,824, filed on Mar. 3, 2009, now Pat. No. 9,149,144, which is a continuation-in-part of (Continued)

(51) Int. Cl.

| | |
|---|---|
| ***A47H 1/00*** | (2006.01) |
| ***A47H 13/01*** | (2006.01) |
| ***A47H 1/04*** | (2006.01) |
| ***A47H 5/032*** | (2006.01) |
| ***A47H 5/14*** | (2006.01) |
| ***A47H 11/02*** | (2006.01) |
| ***A47H 15/02*** | (2006.01) |

(52) U.S. Cl.

CPC ..... *A47H 13/01* (2013.01); *A47H 1/04* (2013.01); *A47H 5/032* (2013.01); *A47H 5/14* (2013.01); *A47H 11/02* (2013.01); *A47H 15/02* (2013.01); *A47H 2001/045* (2013.01); *A47H 2201/01* (2013.01)

(58) Field of Classification Search

CPC . A47H 13/00; A47H 1/00; A47H 1/04; A47H 1/18; A47H 5/032; A47H 11/02; A47H 13/04; A47H 13/02

See application file for complete search history.

(56) References Cited

U.S. PATENT DOCUMENTS

| | | |
|---|---|---|
| 2,280,697 A | 4/1942 | Gaines |
| 2,320,308 A | 5/1943 | Silverman |

(Continued)

OTHER PUBLICATIONS

U.S. Appl. No. 37/799,539, filed Dec. 18, 1973, Ziers.

International Search Report and Written Opinion of PCT/US09/40489; Feb. 3, 2010; 26 pages.

*Primary Examiner* — Katherine Mitchell

*Assistant Examiner* — Jeremy Ramsey

(74) *Attorney, Agent, or Firm* — Luedeka Neely Group, P.C.

(57) ABSTRACT

A curtain system is described which includes a curtain having a plurality of rod engaging members attached thereto, a plurality of rods each having a first end, and a curtain release mechanism attached to each rod at the first end thereof. The rod engaging members each include a stem having a first end and a second end, the first end of the stem configured for engagement with the curtain release mechanism, and a keyway formed in the stem and proximate the first end of the stem.

8 Claims, 24 Drawing Sheets

Related U.S. Application Data application No. 12/274,051, filed on Nov. 19, 2008, now Pat. No. 9,125,509, which is a continuation-in-part of application No. 12/125,711, filed on May 22, 2008, now abandoned.

(56) References Cited

U.S. PATENT DOCUMENTS

| | | | | |
|---|---|---|---|---|
| 2,595,450 | A | | 5/1952 | Coffing |
| 2,884,055 | A | | 4/1959 | Scholer |
| 3,105,543 | A | | 10/1963 | Nolan |
| 3,137,027 | A | | 6/1964 | Birkle |
| 3,585,674 | A | | 6/1971 | Golden |
| 3,616,486 | A | | 11/1971 | Ford et al. |
| 3,638,711 | A | | 2/1972 | Mazzarelle |
| 4,105,011 | A | | 8/1978 | Chism |
| 4,141,105 | A | | 2/1979 | Gonon |
| 4,282,630 | A | | 8/1981 | Toder |
| 4,285,095 | A | | 8/1981 | Janson |
| 4,525,893 | A | | 7/1985 | Fukada |
| 4,675,939 | A | | 6/1987 | Fukada |
| 4,688,620 | A | | 8/1987 | Lechner et al. |
| 4,793,399 | A | | 12/1988 | Pryor |
| 4,796,684 | A | | 1/1989 | Haimovitz |
| 5,217,057 | A | | 6/1993 | Hubbard et al. |
| 5,282,292 | A | | 2/1994 | Levy |
| 5,291,632 | A | | 3/1994 | Akashi |
| 5,379,496 | A | | 1/1995 | Krauss |
| D359,410 | S | | 6/1995 | Domel et al. |
| 5,421,551 | A | | 6/1995 | LeClaire |
| 5,518,058 | A | | 5/1996 | Gastmann |
| 5,543,196 | A | * | 8/1996 | Robinson ..... A01K 1/007 160/330 |
| 5,544,387 | A | * | 8/1996 | Yamamoto ..... A47H 13/00 16/87.2 |
| 5,544,393 | A | | 8/1996 | Lightfoot |
| 5,615,461 | A | | 4/1997 | Tominaga et al. |
| 5,794,461 | A | | 8/1998 | Smith |
| 5,894,642 | A | | 4/1999 | Eberhardt |
| 5,903,957 | A | | 5/1999 | Le Manchec |
| 6,041,454 | A | | 3/2000 | Summerford |
| D425,747 | S | | 5/2000 | Sloan |
| 6,131,243 | A | | 10/2000 | Lee |
| 6,189,597 | B1 | | 2/2001 | Cheng |
| 6,192,965 | B1 | | 2/2001 | Hinds |
| 6,382,297 | B1 | | 5/2002 | Takizawa et al. |
| 6,394,168 | B1 | | 5/2002 | Zoboski |
| 6,564,851 | B1 | | 5/2003 | Liao |
| D482,223 | S | | 11/2003 | Bibby et al. |
| 6,654,990 | B2 | | 12/2003 | Liu |
| D523,675 | S | | 6/2006 | Schorling |
| 7,350,244 | B1 | | 4/2008 | Handley |
| 8,151,385 | B2 | | 4/2012 | Goskowski et al. |
| 8,357,087 | B2 | | 1/2013 | Fetzer |
| 2003/0102091 | A1 | | 6/2003 | Liao |
| 2004/0074613 | A1 | | 4/2004 | Junger et al. |
| 2006/0266483 | A1 | | 11/2006 | Roberts et al. |
| 2007/0261803 | A1 | | 11/2007 | Alexander et al. |
| 2008/0041538 | A1 | | 2/2008 | Granger |
| 2009/0288783 | A1 | | 11/2009 | Graneto, III |
| 2009/0288784 | A1 | | 11/2009 | Graneto, III |
| 2009/0288785 | A1 | | 11/2009 | Graneto, III |
| 2009/0288786 | A1 | | 11/2009 | Graneto, III et al. |
| 2011/0283479 | A1 | | 11/2011 | Peters et al. |
| 2012/0037324 | A1 | | 2/2012 | Graneto, III |

* cited by examiner

SYSTEMS AND METHODS FOR DEPLOYMENT OF CURTAINS

CROSS REFERENCE TO RELATED APPLICATIONS

This application is a continuation application of co-pending application Ser. No. 13/284,062, which is a continuation-in-part application of application Ser. No. 12/773,511 filed May 4, 2010, now U.S. Pat. No. 8,479,800, which is a continuation-in-part of co-pending application Ser. No. 12/396,824 filed Mar. 3, 2009, which is a continuation-in-part application of co-pending application Ser. No. 12/274,051 filed Nov. 19, 2008, which is a continuation-in-part application of application Ser. No. 12/125,711 filed May 22, 2008, now abandoned, all of which are hereby incorporated by reference in their entirety.

BACKGROUND OF THE INVENTION

This invention relates generally to curtains, and more specifically, to methods and systems for deployment of curtains.

Curtains, and more specifically disposable or washable curtains, have long been used, in hospitals for example, to provide privacy, room division, and to a lesser extent, to cover storage areas. Generally, these curtains are suspended from a track on a ceiling for operation. For example, the curtains can be operated to substantially surround a patient's bed for privacy, and retracted at other times when privacy is not an issue.

Most of these curtains have two portions, namely, an upper mesh component and a lower opaque component. The upper mesh component is typically above eye level so the privacy function is not compromised. This mesh component is not necessarily required, however, the opaque portion cannot extend to the ceiling. Generally, the opaque portion cannot extend to the ceiling because if it did, it is possible that it would interfere with ceiling mounted sprinklers in the event of a fire because the water from the sprinklers cannot easily pass through the opaque material. Other reasons that mesh portions are generally incorporated are that they ensure that the opaque portion of the curtain does not interfere with lighting and/or air circulation.

In the hospital application, the curtains become soiled and can collect one or more of bacteria, molds, and viruses (collectively contaminants) during use. This can be a source of cross-contamination, for example, from one patient to one or more of another patient, a health care provider or other staff, and a visitor to the hospital. Unfortunately, hospital curtains are also typically difficult to change and/or wash. Generally, if the curtain is provided in a single, combined mesh portion/opaque portion embodiment, someone has to gain access to the ceiling level of the room to change the curtain. This is difficult, labor intensive, and generally requires that a ladder of some type be used.

There are some known two piece curtains. Generally, the opaque portion is separated from the mesh portion and a new opaque portion is attached to the existing mesh portion. While this may address the need for a ladder, it is still labor intensive and does not address the possibility that the mesh portion retains one or more of the above described contaminants. With respect to the labor required for replacement, the person making the replacement with this type of curtain has to make a plurality of attachments between the opaque and mesh portions while holding the replacement opaque portion of the curtain, or has to operate a zipper or similar device that extends the entire length of the curtain. At least one of the problems with this type of arrangement is that the mesh portion or similar mechanism is generally not in a fixed position, adding to the difficulty of curtain replacement.

BRIEF DESCRIPTION OF THE INVENTION

In one aspect, a curtain system is provided. The curtain system includes a curtain having a plurality of grommets attached thereto proximate a top thereof, a plurality of curtain release mechanisms each comprising a slot formed therein and extending therethrough, and a plurality of rod engaging members. Each of said rod engaging members comprises a stem comprising a first end and a second end, a yoke at said first end of said stem, said yoke configured for engagement with slot in said curtain release mechanism, and a curtain engaging piece at said second end of said stem, said curtain engaging piece configured for a snap fit engagement with a corresponding said grommet.

In another aspect, a curtain is provided that includes a curtain body comprising a plurality of grommets and a plurality of rod engaging members attached to the plurality of grommets of the curtain body. Each rod engaging member includes a stem having a first end and a second end. The first end comprises a yoke that is operable for engagement with a curtain release mechanism, and the second end comprises a curtain engaging piece that provides attachment to one of the grommets of the curtain body.

In still another aspect, a curtain release mechanism is provided that includes a housing, a slot formed in said housing and extending therethrough, said slot proximate a first end of said curtain release mechanism, a release mechanism within said housing and operably accessible via said slot, said release mechanism operable for engagement with a yoke associated with a curtain, a protrusion formed in said housing at a second end thereof, and a sleeve comprising a proximal end operable for engagement with said protrusion and a distal end operable for attachment to a slidable component associated with a suspendable track.

DETAILED DESCRIPTION OF THE INVENTION

Figure 1:
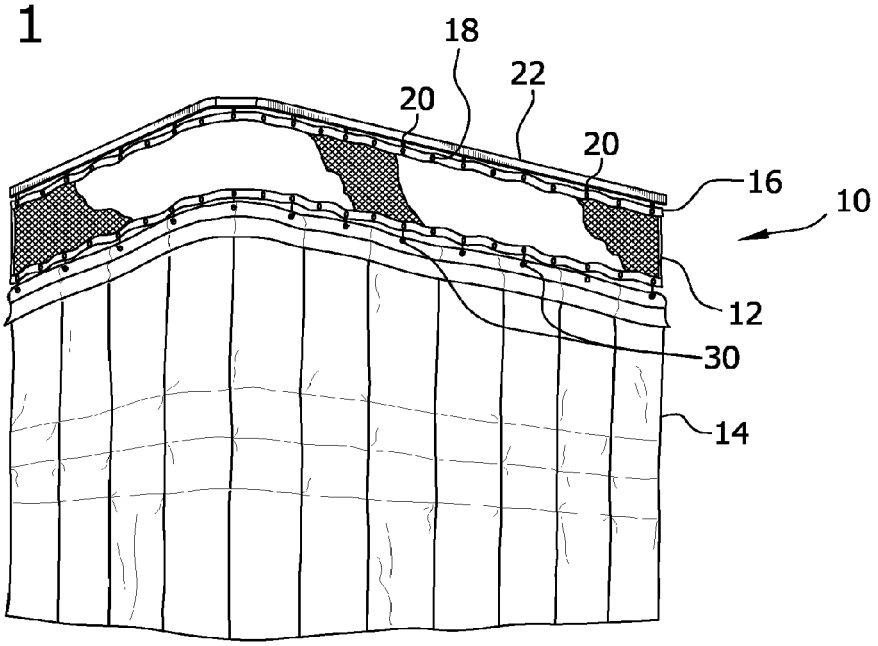
FIG. 1 is an illustration of a known privacy curtain system.

FIG. 1 is a perspective view of a known privacy curtain 10. Curtain 10 includes an upper mesh portion 12 and a lower opaque portion 14 that is suspended from the upper mesh portion 12. The lower opaque portion 14 is removable from the upper mesh portion 12. As described above, the upper mesh portion is constructed in part from a mesh material to allow for lighting, air circulation, and the operation of fire sprinklers. The lower opaque portion is constructed from an opaque material to provide privacy when the curtain 10 is in an extended position. The curtain 10 is suspended from a track 20 attached to a ceiling 22 as is well known. In this example, the upper mesh portion 12 of curtain 10 and the lower opaque portion 14 include a series of mating fasteners 30. The mating fasteners 30 are provided to removably suspend the lower opaque portion 14 from the upper mesh portion 12. The upper mesh portion 12 is configured with reinforced holes 18 which are engaged by hooks (not shown) hanging from track 20.

As discussed above, conventional privacy curtains tend to become soiled and are prone to contamination with one or more bacteria, mold, and viruses. To address this issue, the lower opaque portion 14 may be disposable, and can be changed as often as necessary to address the issues noted above. Since the lower opaque portion 14 provides the privacy function, the upper mesh portion 12 is suspended near the ceiling and is, therefore, not in a position where it is less likely to present the cross-contamination risk associated with the lower opaque portion 14. Therefore, the upper mesh portion 12 need not be changed nearly as frequently as the lower opaque portion 14.

While the configuration of FIG. 1 addresses many known problems, some still exist. One, it cannot be assured that the upper mesh portion 12 is free from the contamination described above. Two, while the fasteners 30 may be at a comfortable work level, it is still difficult for personnel to attach a replacement lower opaque portion 14 to the upper mesh portion 12. This difficulty is due to the fact that the area of upper mesh portion 12 where the fasteners 30 are located is prone to movement as it is distant from the engagement of the upper mesh portion 12 with the track 20.

At least one other privacy curtain system incorporates a series of rods between the ceiling and the curtain. This system provides the lighting and fire sprinkler considerations mentioned above, while still addressing the contamination issue. Examples of these systems are shown in FIG. 2.

Figure 2:
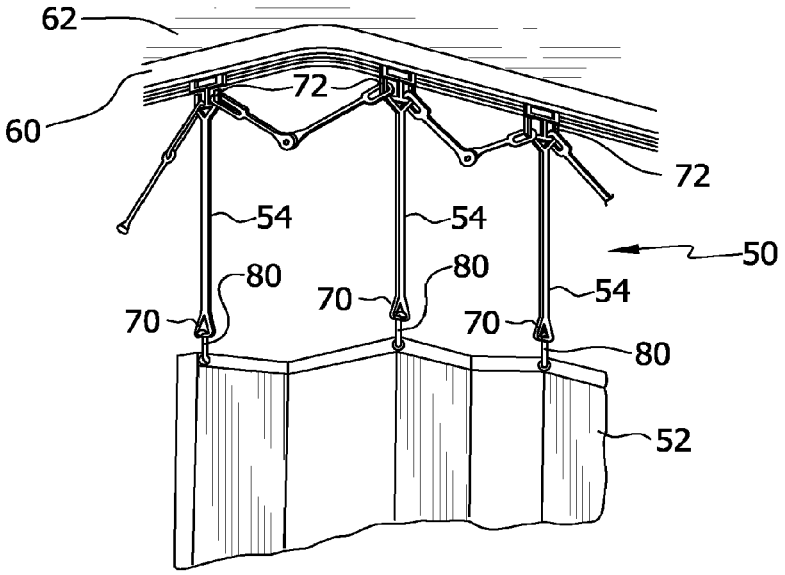
FIG. 2 is an illustration of a hanger assembly from which a privacy curtain is suspended.

Referring to FIG. 2, a hanger assembly 50 is illustrated that is configured for the suspending of a curtain 52 similar to the lower opaque portion 14 shown in FIG. 1. A plurality of rods 54 extend down from a track 60 that is attached to a ceiling 62. While the assembly of FIG. 2 has several features, one feature that is common with the curtain system of FIG. 1 is that a lower end 70 of the rods 54 is relatively free to move with respect to a user, as it can essentially pivot about its upper end 72. In addition, the rods 54, especially at the lower end 70 are free to move with respect to each other. This freedom of movement causes difficulty for the person removing an old curtain 52 and installing a new curtain 52 at the lower end.

Another issue with the system of FIG. 2 is that curtain 52 has to be removed from each rod 54 individually, and a new curtain 52 has to be attached to each rod 54 individually as individual hooks 80, engaged with the lower end 70 of rods 54 are utilized to attach curtain 52 to rods 54. Generally, when a person replaces one of curtains 10 and 52, they have to gather up the curtain in their arms to control the bulk of the curtain while they detach the curtain from the rod or upper mesh portion. While it may never be possible to completely eliminate personnel contact with soiled and/or contaminated curtains, it is possible to reduce the amount of contact between the two as further explained herein.

The following descriptions, and accompanying figures, are related to embodiments that address some of the issues described above with respect to the removal of old curtains, and the subsequent attachment of new curtains.

Figure 3:
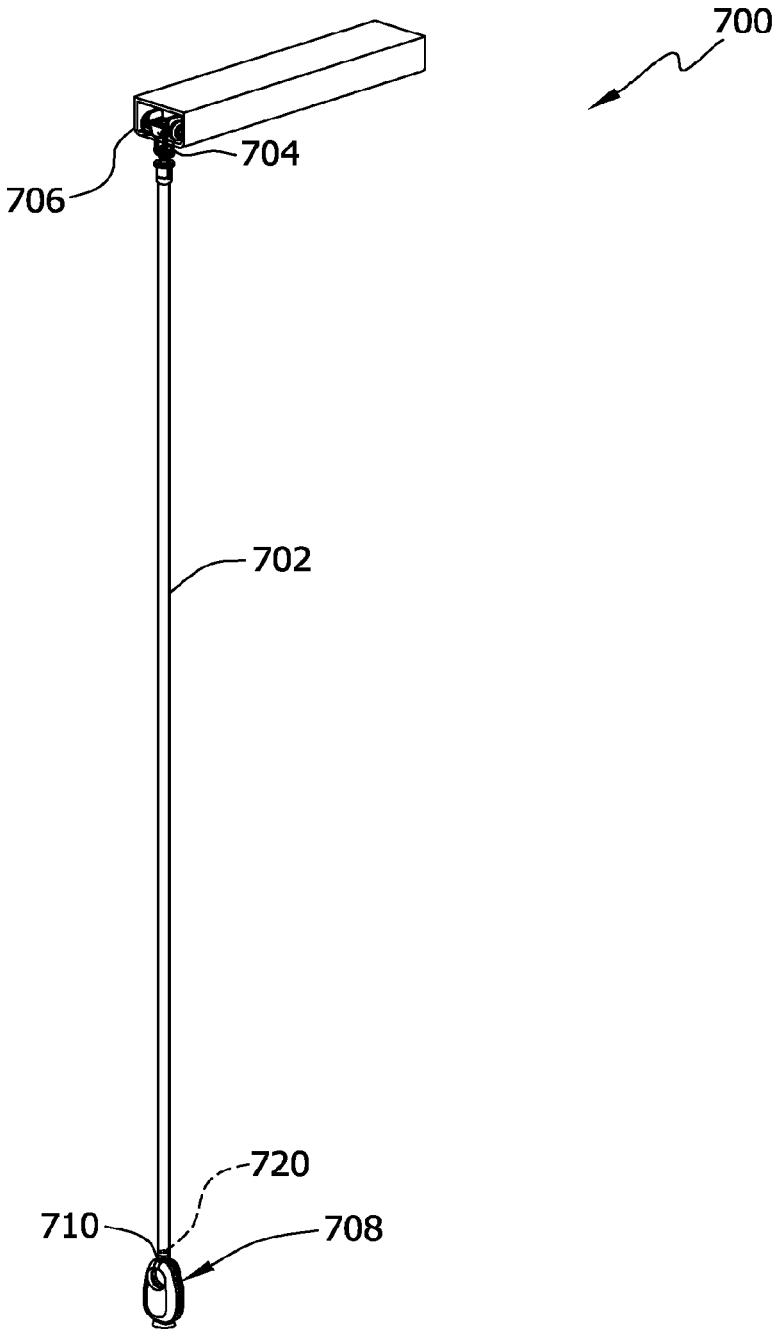
FIG. 3 is a perspective view of an alternative embodiment of a hanger assembly from which a curtain can be suspended.

FIG. 3 is a perspective view of an embodiment of a hanger assembly 700 from which a curtain can be suspended. Hanger assembly 700 may also sometimes be referred to as a curtain suspension system. Hanger assembly 700 includes a curtain rod 702, a ceiling track engaging component 704 configured for engagement with a first end 706 of rod 702, and a curtain release mechanism 708 configured for engagement with a second end 710 of rod 702. As will be explained with respect to the following figures, hangar assembly 700 differs from the assemblies described above in that a key is inserted through the curtain release mechanisms 708 to release a curtain rather than through a rod engaging member as in the embodiments described above. As is easily understood, to form an operable hanger assembly 700, a plurality of rods 702 and associated components are utilized. To that end, in one embodiment rods 702 are hollow and may include one or magnets 720 disposed near the bottom 722 thereof. As is described further, the presence of these magnets 720 is helpful in maintaining a substantially adjacent and parallel orientation for a plurality of rods 702 when a curtain is being removed from the rods 702 and associated curtain release mechanisms 708 or installed onto same.

Figure 4:
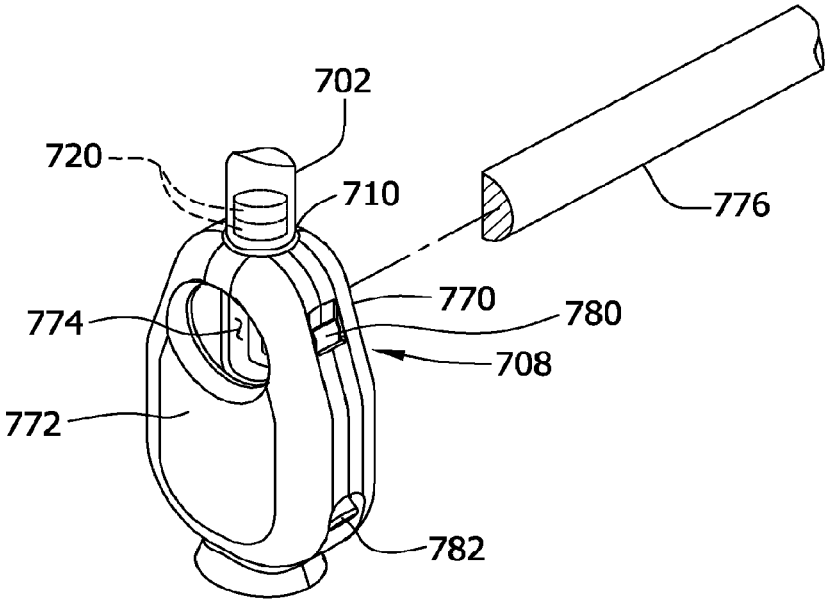
FIG. 4 is a side view of a curtain release mechanism attached to the rod illustrated in FIG. 3.

FIG. 4 is a perspective view of the curtain release mechanism 708 attached to the second end 710 of rod 702. Curtain release mechanism 708 includes a first body half 770 and a second body half 772 that engage one another in a snap fit arrangement to house a rotatable tumbler 774. A key 776 is utilized to rotate tumbler 774 to release a rod engaging member 800 (shown in FIG. 5). In the illustrated embodiment, and as further described below, curtain release mechanism 708 includes two indicators that work somewhat in tandem. A tumbler position indicator 780 and a locking mechanism indicator 782 are shown in the illustrated embodiment and are further described below.

Figure 5:
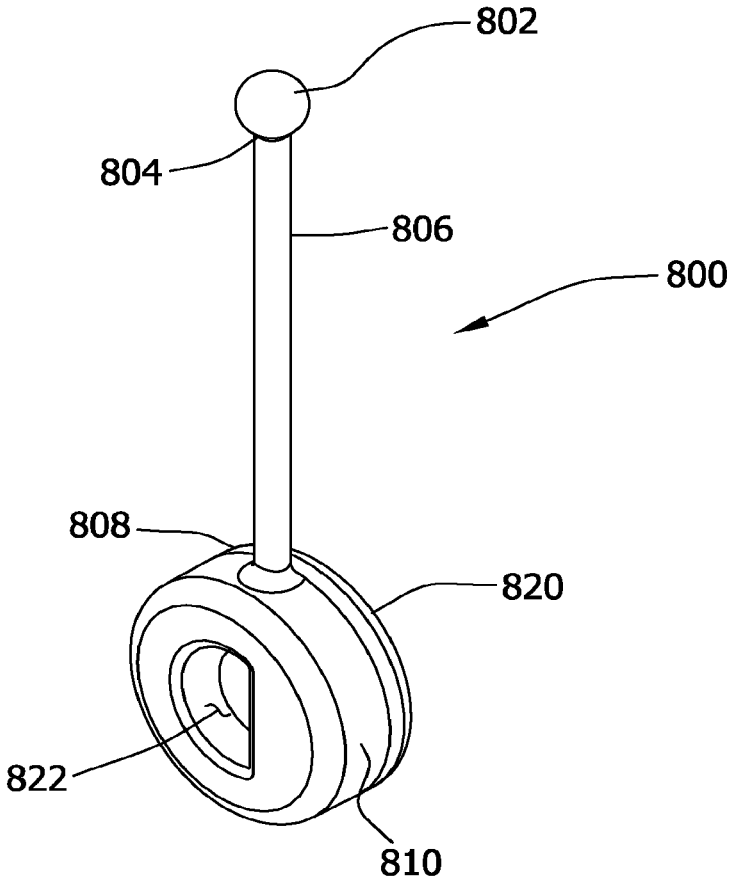
FIG. 5 is a side view of an alternative embodiment of a rod engaging member engaging the curtain release mechanism of FIG. 4.
Figure 16:
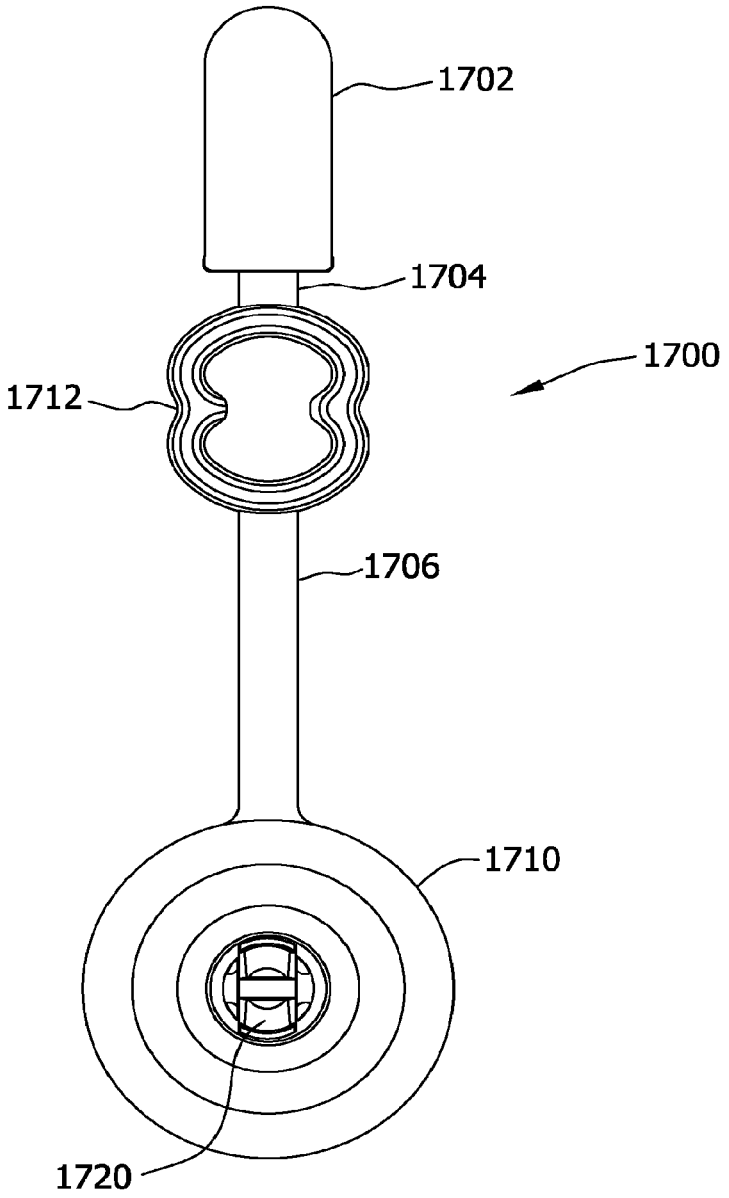
FIG. 16 is a side view of a rod engaging member that includes a yoke and a molded keyway within the stem proximate the yoke.

FIG. 5 is a side view of an alternative embodiment of a rod engaging member 800 configured to engage the curtain release mechanism 708 of FIG. 16. Rod engaging member 800 includes a release mechanism engaging member 802 extending from a first end 804 of a stem 806 which also has a second end 808 that is attached to a first curtain engaging piece 810. In one embodiment, release mechanism engaging member 802, stem 806, and first curtain engaging piece 810 are formed as a single item from injection molded plastic. In the illustrated embodiment, release mechanism engaging member 802 is substantially spherical, but other shapes are contemplated as long as the rotatable tumbler of the curtain release mechanism 708 is configured to engage such a shape. A second curtain engaging piece 820 is configured for snap fit engagement with first curtain engaging piece 810 with a portion of a curtain therebetween. The first curtain engaging piece 810 and the second curtain engaging piece 812 are both configured with a keyway 822 therethrough such that when press fit together, the key 776 (shown in FIG. 4) may extend therethrough.

Generally, a curtain (not shown in FIG. 5) is fabricated to include a plurality of the described rod engaging members 800. A user may insert the key 776 through the multiple keyways 822 of a bundled curtain to provide support when installing the multiple rod engaging members 800 into the corresponding curtain release mechanisms 708 (shown in FIG. 4).

Figure 6:
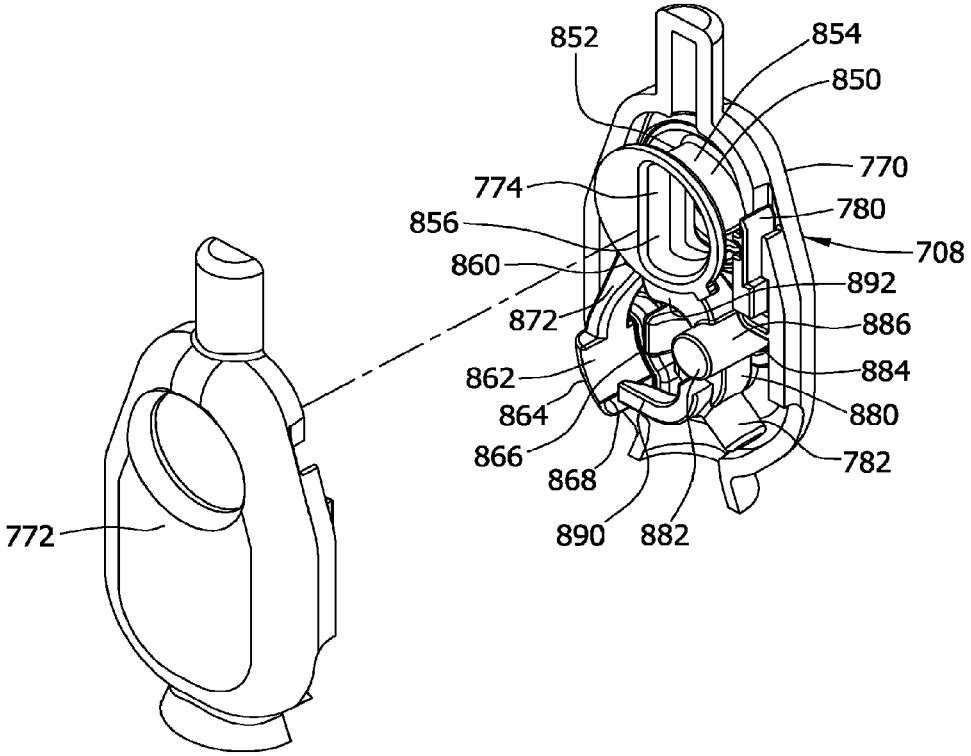
FIG. 6 is an exploded view of the curtain release mechanism of FIG. 4.

FIG. 6 is an exploded view of the curtain release mechanism 708 of FIG. 4 which illustrates in further detail the above mentioned rotatable tumbler 774. The rotatable tumbler 774 as described above includes a keyed member 850 that is configured for rotation between the first body half 770 and the second body half 772 of the curtain release mechanism 708. The rotatable tumbler 774 includes the lock state indicator 780 described above. The keyed member 850 includes a flat surface 852 on the outside diameter 854 of the keyed portion 856 that engages a first end 860 of a flexible latch 862 that is held in place between the first body half 770 and the second body half 772 by laterally extending tabs 864 and 866 proximate a second end 868 of the flexible latch 862. The flexible latch includes a tang (not shown) proximate a mid-section 872 of the flexible latch 862.

A pivoting member 880 is also held in place between the first body half 770 and the second body half 772 by laterally extending posts 882 and 884 proximate a mid-section 886 of the pivoting member 880. A forked end 890 of the pivoting member 880 is configured to engage the release mechanism engaging member 802 and a tang engaging member 892 is configured to engage the tang in the flexible latch 862. The locking mechanism indicator 782 extends through a window formed in the first body half 770 and the second body half 772.

When the keyed member 850 is turned, the flat surface 852 changes position, causing the flexible latch 862 to flex, thereby releasing the tang from the tang engaging member 892. This release allows the pivoting member 880 to pivot so that the release mechanism engaging member 802 can fall away from the forked end 890 of the pivoting member 880, releasing the curtain. When a release mechanism engaging member 802 and corresponding stem 806 are then inserted into the curtain release mechanism 708, the release mechanism engaging member 802 will push against the tang engaging member 892 so that the pivoting member 880 pivots into a position where the tang engaging member 892 reengages the tang. This reengagement also causes the position of the forked end 890 to move to a position such that the release mechanism engaging member 802 is not able to pass through the forked end 890 of the pivoting member 880.

With respect to the indicators 780 and 782, indicator 780 is visible and generally indicates the tumbler 774 is locked and that a rod engaging member 800 is being held by the tumbler 774. When the lock state indicator 780 is not visible and the locking mechanism indicator 782 is visible, it is generally an indication that the rod engaging member 800 has been released. For insertion, and subsequent locking in place of a replacement rod engaging member 800, the curtain release mechanism must be armed, which entails turning the tumbler 774 back to the original position, with the lock state indicator 780 again visible. The locking mechanism indicator 782 is also visible at this time. When a replacement rod engaging member 800 is inserted into an armed curtain release mechanism 708, the release mechanism engaging member 802 engages the flexible latch 862, causing the pivoting member 880 to rotate somewhat, and lock in place. Upon completion of this step, locking mechanism indicator 782 is retracted back into the curtain release mechanism, and is no longer visible.

Figure 7:
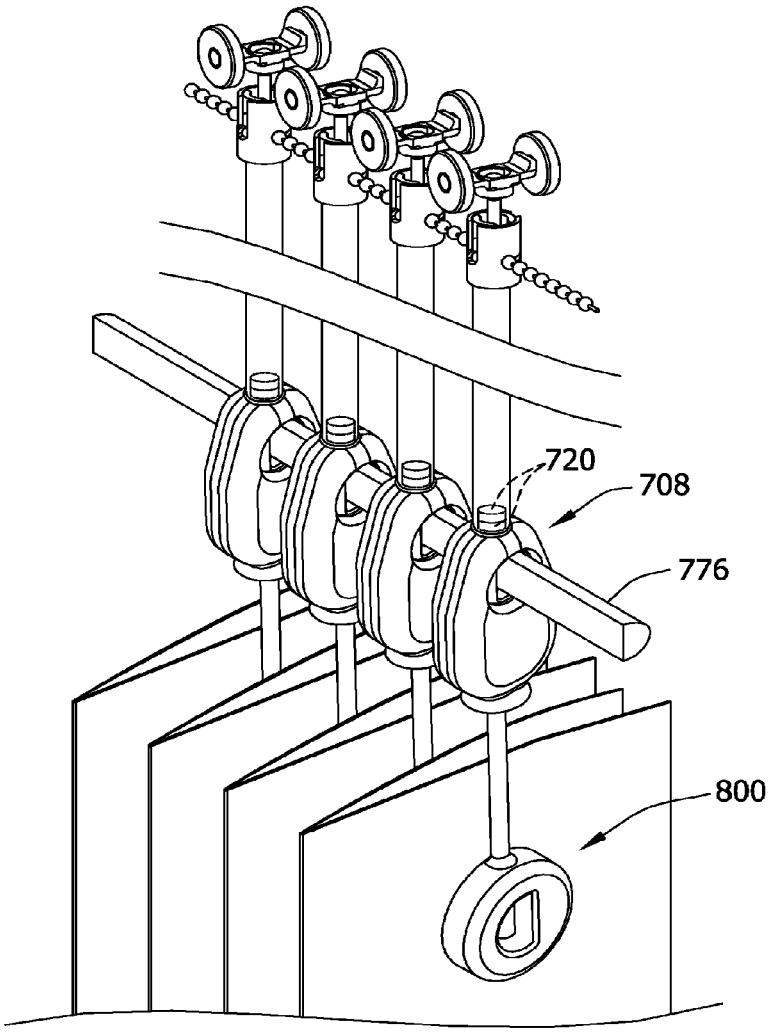
FIG. 7 is a perspective view of several curtain portions that each include a rod engaging member extending therefrom, the rod engaging members engaging respective curtain release mechanisms, a key extending through the curtain release mechanisms in preparation of releasing the rod engaging members therefrom.

FIG. 7 is a perspective view of several curtain portions that each include a rod engaging member 800 extending therefrom, the rod engaging members 800 engaging respective curtain release mechanisms 708, a key 776 extending through the curtain release mechanisms 708 in preparation of releasing the rod engaging members 800 therefrom.

Figure 8:
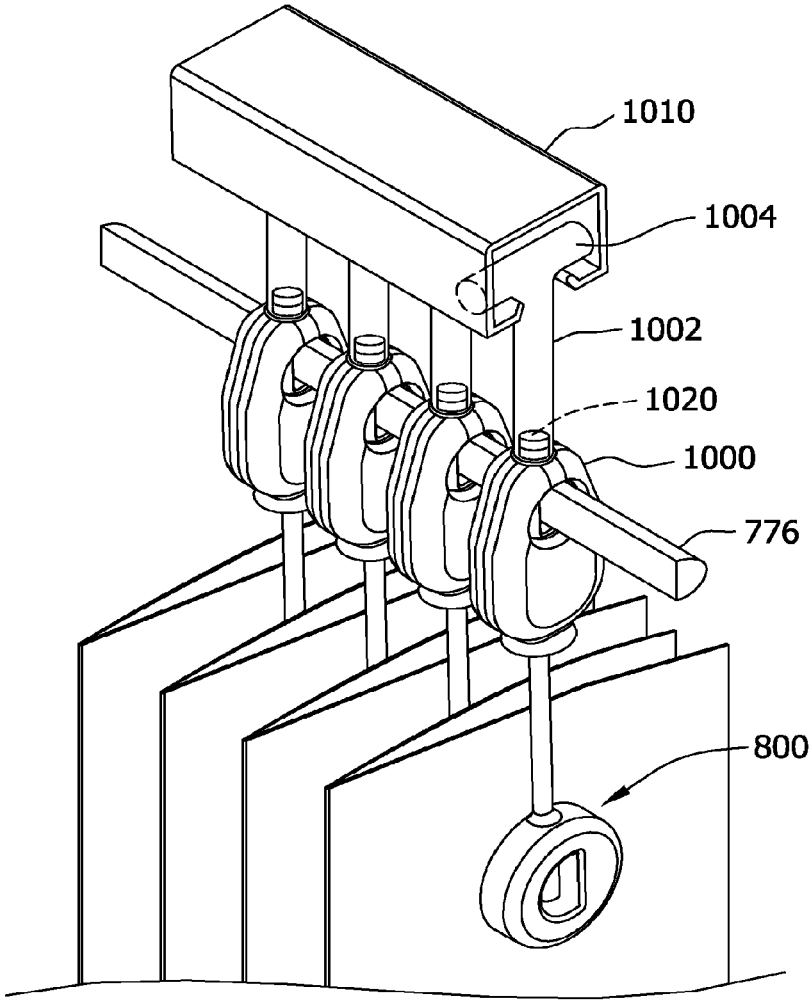
FIG. 8 is a diagram that illustrates an embodiment of a curtain release mechanism useful in locations with lower ceilings

FIG. 8 is a diagram that illustrates an alternative embodiment of a curtain release mechanism 1000 which may be useful in locations with lower ceilings, or in locations where ventilation and fire safety requirements described above may not apply. In one practical example, the embodiment illustrated in FIG. 21 may be utilized in front of a closet or pantry.

The illustrated embodiment still provides an ability to replace curtains as described throughout this document, but does not incorporate the above described rods 702. Instead, the curtain release mechanisms 1000 each include a ceiling track engaging component 1002 extending directly therefrom. In the illustrated embodiment, the ceiling track engaging component 1002 is a "T" shaped component, the top 1004 of which is configured to extend across and slidably engage a ceiling track 1010. Embodiments that incorporate rollers as described above are also contemplated. One main difference between the embodiments described with respect to FIG. 20 and the embodiments which incorporate the rods 702 is length. As a non limiting example, the ceiling track engaging component 1002 is generally less than six inches in length while the above described rods 702 are generally in excess of twelve inches in length. Of course embodiments of each are contemplated that are outside of these general guidelines.

The ceiling track engaging component 1002 may also incorporate magnets 1020. With the exception of the length generally associated with the ceiling track engaging component 1002, operation of curtain release mechanism 100 is otherwise identical to that of the above described curtain release mechanism 708 (shown in FIG. 18).

Figure 9:
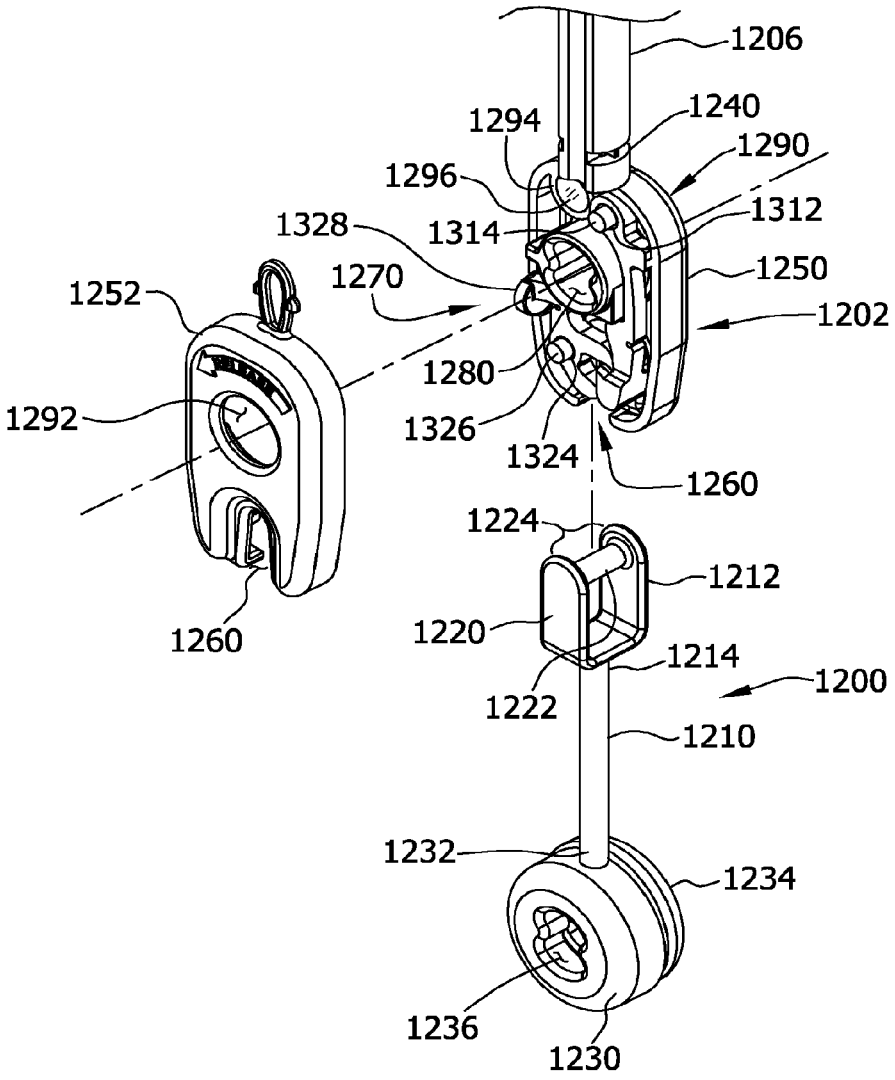
FIG. 9 is a perspective view of another curtain installation and removal configuration.

FIG. 9 is a perspective view of yet another curtain installation and removal configuration. This configuration includes a rod engaging member 1200 and a curtain release mechanism 1202 that is attached to a rod 1206. As is easily understood from the other embodiments described herein, a plurality of rod engaging members 1200 may be attached to a curtain (not shown in FIG. 9). Referring again to rod engaging member 1200, it includes a stem 1210 and a yoke 1212 extending from a first end 1214 of the stem 1210. The yoke 1212 includes a U-shaped member 1220 and a cylindrical member 1222 extending across an opening 1224 associated with the U-shaped member 1220. As is easily determined from FIG. 22, the cylindrical member 1222 is configured to engage components associated with the curtain release mechanism 1202. A first curtain engaging piece 1230 extends from a second end 1232 of the stem 1210 and a second curtain engaging piece 1234 is configured for snap fit engagement with said first curtain engaging piece 1230 with a portion of a curtain therebetween. U-shaped member 1220, cylindrical member 1222, stem 1210, and first curtain engaging piece 1230 are integrally formed, in one embodiment. A curtain aperture 1236 is formed in both the first curtain engaging piece 1230 and the second curtain engaging piece 1234 (and also the corresponding curtain) for insertion of a key (not shown in FIG. 22) that is helpful in attaching and/or removing curtains incorporating rod engaging members 1200 to and/or from rods 1206.

The curtain release mechanism 1202 is attached to rod 1206 at a first end 1240 thereof. The two body halves 1250 and 1252 that make the chassis of curtain release mechanism 1202 each include a slot 1260 formed near a bottom thereof and extending therethrough. The curtain release mechanism 1202 includes a user operable mechanism 1270 maintained between the two body halves 1250 and 1252 which is operable for retention of the yoke 1212 upon its insertion into the slot 1260. The user operable mechanism 1270 is further operable for substantially simultaneous release of the yokes 1212, and therefore a curtain, from a plurality of the curtain release mechanisms 1202.

The user operable mechanism 1270 is held between the two body halves 1250 and 1252 as mentioned above and has a key aperture 1280 therethrough. The first body half 1250 and the second body half each have holes, 1290 and 1292 respectively, formed therein for alignment with the key aperture 1280. In one embodiment, one or both of the two body halves 1250 and 1252 are molded to include a receptacle 1294 into which a magnet 1296 or a plurality of magnets can be inserted. Magnet(s) 1296 provide essentially the same function as is described above in that they are oriented such that they help to maintain a plurality of rods 1206 and curtain release mechanisms 1202 in a position substantially adjacent one another when changing a curtain. In an alternative embodiment, magnets may be incorporated into the rod 1206, similar to the configuration shown in FIGS. 14 and 16, to provide the same functionality as magnets 1296. In another embodiment, both magnets 1296 as well as magnets within rod 1206 are contemplated.

Figure 11:
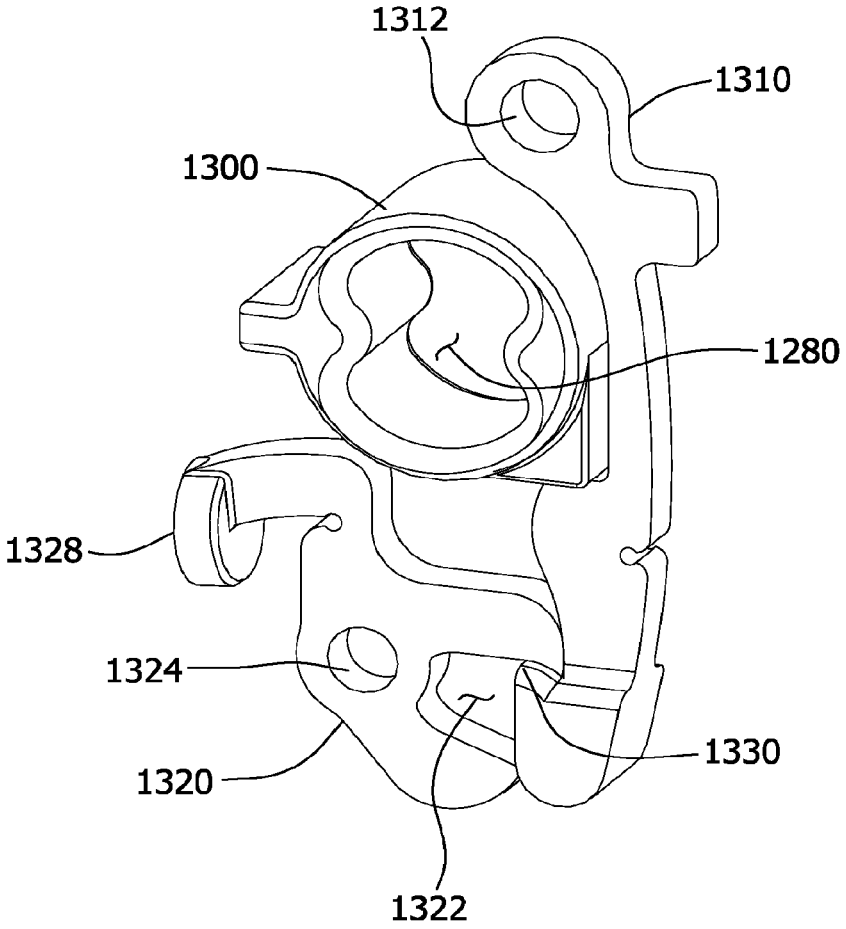
FIG. 11 is a detailed view of the user operable mechanism of FIG. 10.

Now referring to FIG. 11, a front view of the user operable mechanism 1270 is provided. Receptacle 1294 and magnet 1296 are also shown. The user operable mechanism 1270 includes a tumbler 1300 configured for rotation, and positioned between, the first body half 1250 and the second body half 1252. In one embodiment, the tumbler 1300 includes the key aperture 1280 mentioned above. A spring latch 1310 is maintained in position between the first body half 1250 and the second body half 1252. A hole 1312 formed in spring latch 1310 engages a pin 1314 that is formed as part of body half 1250 allowing for rotational movement of spring latch 1310 thereabout. This rotational movement is constrained, as is easily understood, by the other components of curtain release mechanism 1202. A toggling member 1320 is also maintained in position between the first body half 1250 and the second body half 1252 and includes a yoke engaging slot 1322 formed therein. A hole 1324 formed in toggling member 1320 engages a pin 1326 that is formed as part of body half 1250 allowing for rotational movement of toggling member 1320 thereabout. This rotational movement is constrained, as is easily understood, by the other components of curtain release mechanism 1202.

As shown in FIG. 11, the spring latch 1310 includes a tang 1330 formed therein that is configured to engage the yoke engaging slot 1322 of the toggling member 1320 and maintain the toggling member 1320 in a first position when the tumbler 1300 is in a first position. One embodiment of toggling member 1320 includes an indicator 1328 which engages a window 1329, formed by semicircles molded in the first body half 1250 and the second body half 1252, when the toggling member 1320 is in the first position. This indicator 1328 is more clearly shown in FIG. 28. When the tumbler 1300 is rotated to a second position (not shown in FIG. 24), the tang 1330 of the spring latch 1310 is disengaged from the toggling member 1330 which allows the toggling member 1320 to rotate due to the weight of the yoke 1212 (and a curtain attached thereto) thereby allowing the yoke 1212 to disengage from the toggling member 1320 and fall from the slot 1260 (shown in FIGS. 22 and 23). When the toggling member 1328 is in the second position, the indicator 1328 is not within the window 1329.

Figure 10:
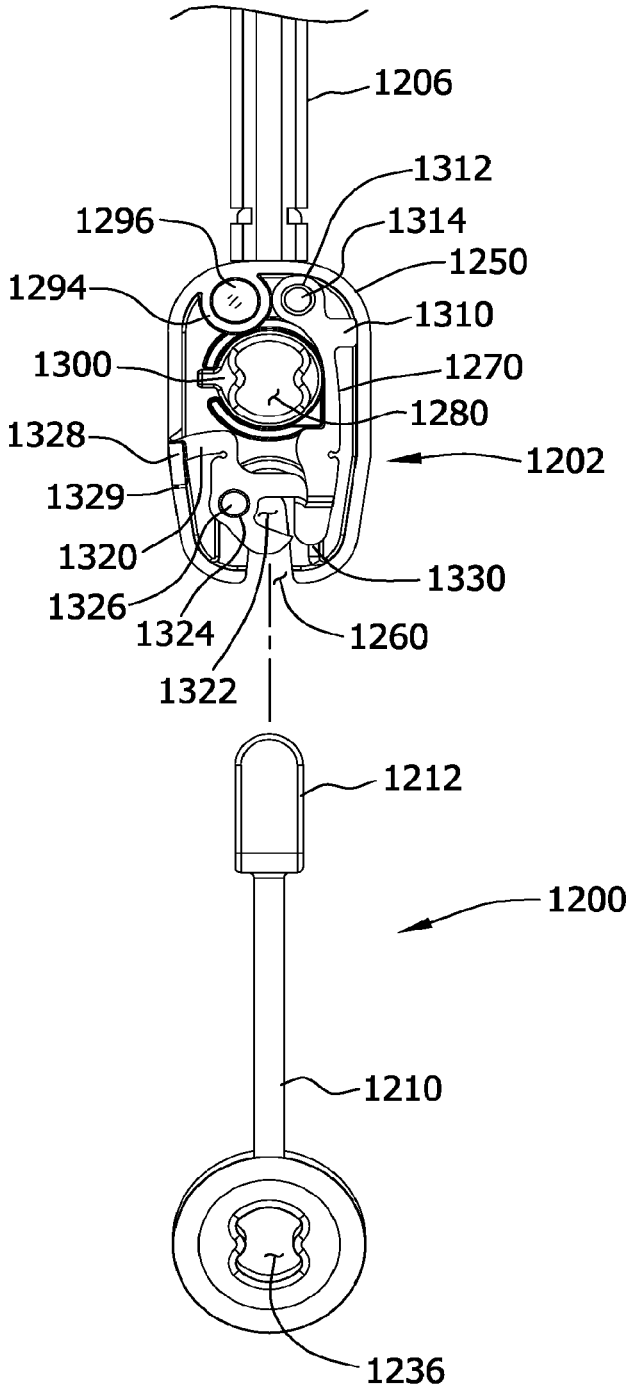
FIG. 10 is a front view of a user operable mechanism for attaching and releasing curtains.

As can be discerned from FIGS. 10 and 11, when the toggling member 1320 is in the first position, the yoke engaging slot 1322 is substantially perpendicular with the slot 1260. The substantial perpendicularity between slot 1322 and slot 1260 operates to retain the yoke 1212. A key is utilized in one embodiment to turn a plurality of the tumblers 1300 to release, or alternatively lock in position, a curtain such as has been extensively described herein. In one specific embodiment, the weight of the various components of toggling member 1320 substantially surrounding slot 1322 is increased with respect to the other components such that the toggling member 1320 easily rotates under the weight of the curtain when release of the curtain is desired.

In other embodiments, tumbler 1300, spring latch 1310, and toggling member 1320 combine to form a safety mechanism. Specifically, if a specific pulling pressure is applied to a curtain, and hence through the yoke 1212 onto these components, the components will flex under the strain and ultimately release the yoke 121 and hence the curtain. In specific embodiments, the pressure for such a release ranges from 8-20 pounds, though through adjustment of various features of tumbler 1300, spring latch 1310, and toggling member 1320 the release point can be at a lesser pressure or at a greater pressure. As far as a safety mechanism, such embodiments operate to reduce the likelihood that a ceiling track and curtain rods will be pulled from their ceiling mounting in the event of an unexpected pressure being exerted on the curtain.

Figure 12:
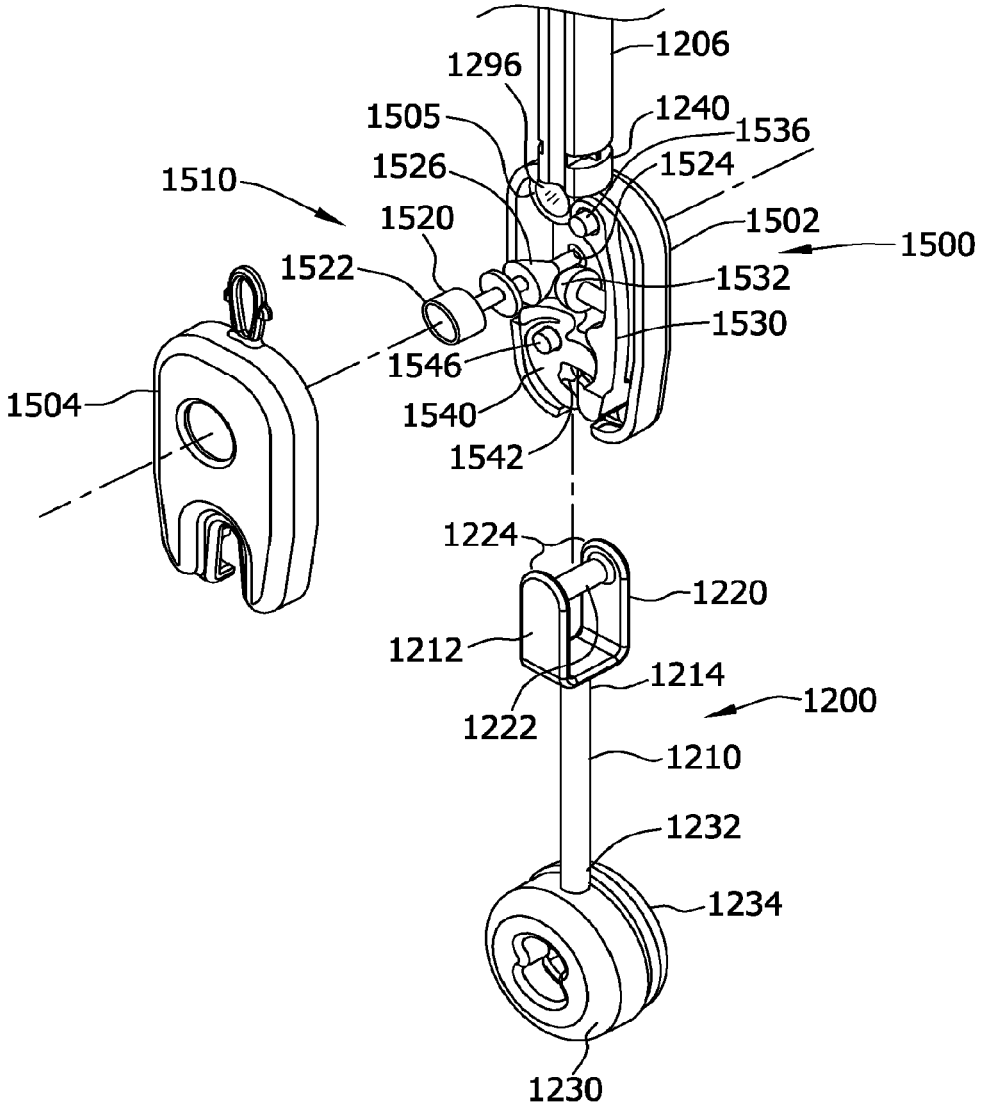
FIG. 12 is an illustration of another embodiment of curtain release mechanism contemplated for utilization with a rod and a rod engaging member.

FIG. 12 is an illustration of another embodiment of curtain release mechanism 1500 that is contemplated for utilization with rod 1206 and rod engaging member 1200. Curtain release mechanism 1500 includes a first body half 1502 and a second body half 1504 that enclose at least a portion of a user operable mechanism 1510 that is operable to retain and subsequently release a rod engaging member 1200. In one embodiment, one or both of the two body halves 1502 and 1504 are molded to include a receptacle 1505 into which a magnet 1296 or a plurality of magnets can be inserted. Magnet(s) 1296 provide essentially the same function as is described above in that they are oriented such that they help to maintain a plurality of rods 1206 and curtain release mechanisms 1500 in a position substantially adjacent one another when changing a curtain. In an alternative embodiment, magnets may be incorporated into the rod 1206, similar to the configuration shown in FIGS. 14 and 16, to provide the same functionality as magnets 1296. In another embodiment, both magnets 1296 as well as magnets within rod 1206 are contemplated.

Both the first body half 1502 and the second body half 1504 include slots 1506 formed therein which work with user operable mechanism 1510 in the same manner as described above. In the illustrated embodiment, the user operable mechanism 1510 includes an elongated actuator 1520 that extends through the first body half 1502 and the second body half 1504. The elongated actuator 1520 includes a push button end 1522, a push button engaging end 1524, and a conical member 1526 disposed therebetween. Push button end 1522 extends through second body half 1504 and push button engaging end 1524 extends through first body half 1502 as can be discerned from the Figure.

Figure 13:
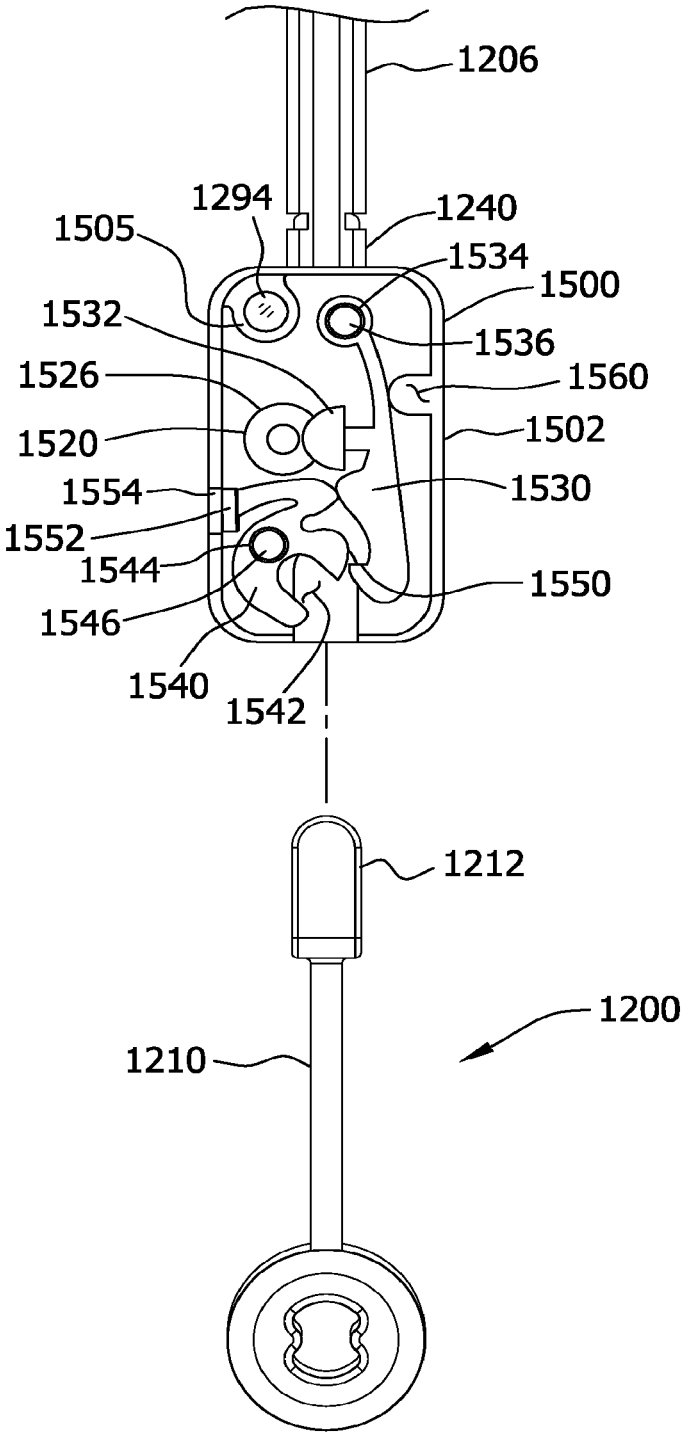
FIG. 13 is a front view of certain components associated with the curtain release mechanism of FIG. 12.

Referring both to FIGS. 12 and 13, a return spring 1530 is maintained in a rotatable position between the first body half 1502 and the second body half 1504. The return spring 1530 includes a lever 1532 disposed thereon. The lever 1532 is positioned for sliding engagement with the conical member 1526. A hole 1534 formed in return spring 1530 engages a pin 1536 that is formed as part of body half 1502 allowing for rotational movement of return spring 1530 thereabout. This rotational movement is constrained, as is easily understood, by the other components of curtain release mechanism 1500.

A toggling member 1540 is maintained in a rotatable position between the first body half 1502 and the second body half 1504 and includes a yoke engaging slot 1542 formed therein. A hole 1544 formed in toggling member 1540 engages a pin 1546 that is formed as part of body half 1502 allowing for rotational movement of toggling member 1540 thereabout. This rotational movement is constrained, as is easily understood, by the other components of curtain release mechanism 1500.

Referring specifically to FIG. 13, the return spring 1530 includes a tang 1550 that mechanically engages the toggling member 1540 to maintain the toggling member 1540 in a first position to retain a yoke 1212 when the elongated actuator 1520 is in a first position. When the elongated member 1520 is in the second position, as depicted in FIG. 13, the tang 1550 is removed from engagement with the toggling member 1540 due to the interaction between the conical member 1526 and the lever 1532. As a result, the toggling member 1540 is allowed to rotate thereby also allowing the yoke 1212 to disengage from the toggling member 1540.

More specifically, when the elongated member 1520 is moved from a first position to a second position, movement of the conical member 1526 occurs in a lateral direction. The engagement between the conical member 1526 and the lever 1532 thereby causes the return spring 1530 to rotate from a first position to a second position. A first position of the return spring 1530 prevents rotation of the toggling member 1540 thereby retaining the yoke 1212 as described above. A second position of the return spring 1530, as shown in FIG. 27, allows rotation of the toggling member 1540, and therefore subsequent disengagement of a yoke 1212 engaged therewith. One embodiment of toggling member 1540 includes an indicator 1552 which engages a window 1554, formed by semicircles molded in the first body half 1502 and the second body half 1504, when the toggling member 1540 is in the first position.

In one embodiment, a pressure is applied to the push button 1522 is operable to move the elongated member 1520 from the first position to the second position. In the embodiment, the curtain release mechanism 1500 includes at least one spring component which operates to cause the elongated member 1520 and the return spring 1530 to return to their respective first position when the pressure is released from the push button 1522. In the illustrated embodiment, the spring component is an appendage 1560 that is formed in at least one of the first body half 1502 and the second body half 1504. In this embodiment, the appendage 1560 is engaged by the return spring 1530 when the return spring 1530 is moved from the first position to the second position. The return spring 1530 is fabricated from a resilient material which causes the return spring 1530 to tend to return to the first position in the absence of an external force dictating otherwise. In another embodiment, the push button engaging end 1524 is configured to engage the push button 1522 of an adjacent curtain release mechanism 1500, to allow substantially simultaneous release of multiple rod engaging members 1200 from respective adjacent curtain release mechanisms 1500.

Figure 14:
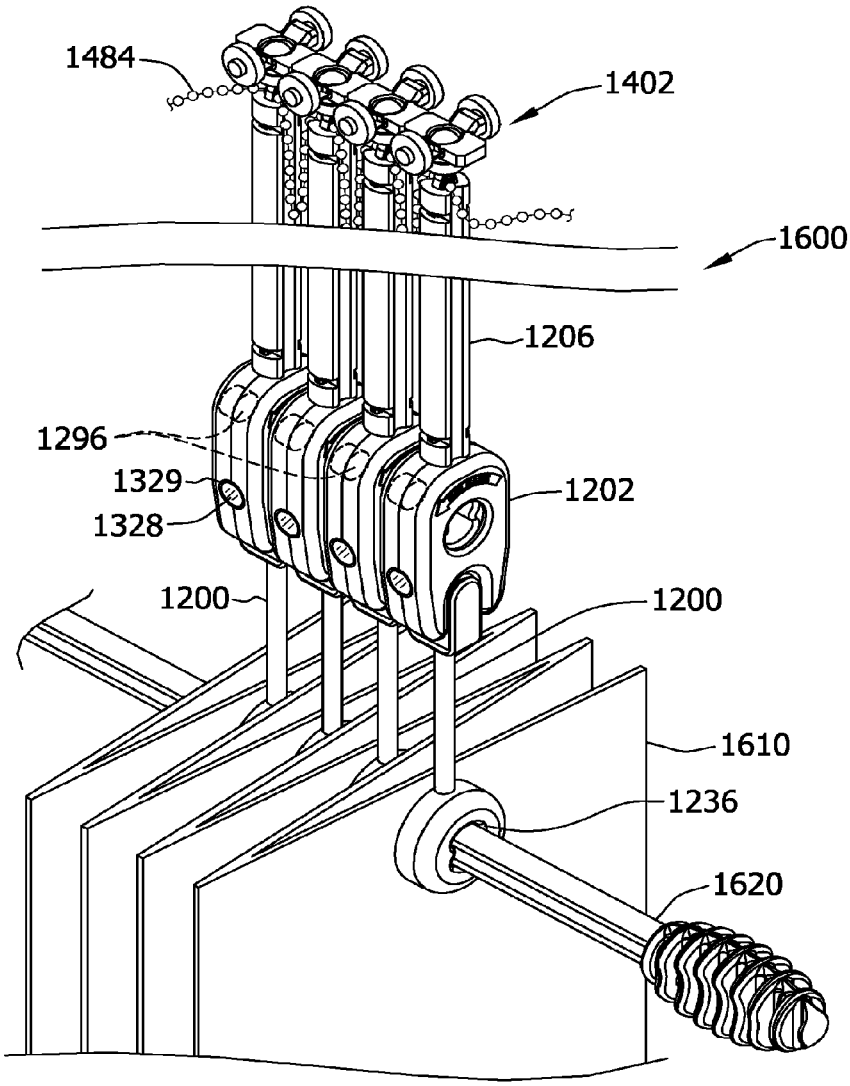
FIG. 14 illustrates a curtain suspension system incorporating the components described with respect to FIGS. 9-11.

FIG. 14 illustrates a curtain suspension system 1600 that includes various embodiments described with respect to FIGS. 22-25 along with a curtain 1610. A key 1620 is operable to engage the multiple key apertures 1236 associated with multiple rod engaging members 1200 for ease in attaching the curtain 1610, more specifically the rod engaging members 1200 to the rods 1206, with the magnets 1296 helping to maintain the orientation of rods 1206 and curtain release mechanisms 1202 as described herein. As also described herein, the remainder of system 1600 includes the curtain release mechanisms 1202 attached to the rods 1206 and the ceiling track engaging components 1402 attached at the opposite ends of the rods 1206.

Figure 15:
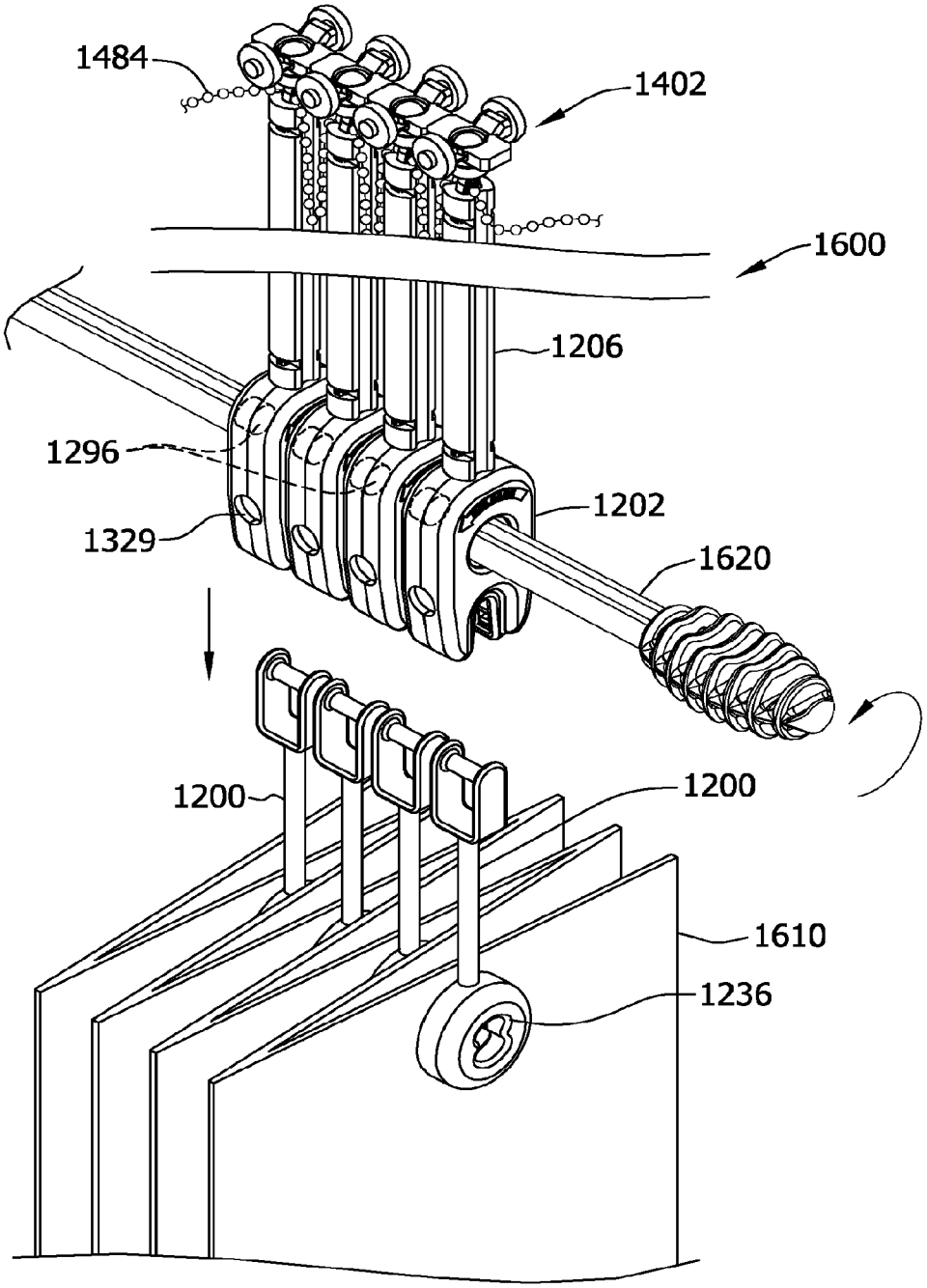
FIG. 15 illustrates removal of a curtain from a curtain suspension system that incorporates the components described with respect to FIGS. 9-11.

As is understood from the disclosure above, and as shown in FIG. 15, key 1620 is also operable for insertion through the multiple key apertures associated with the multiple curtain release mechanisms 1202 to operate the associated tumblers and release the curtain 1610 both as shown and as further described herein.

FIG. 16 is a side view of a rod engaging member 1700 that includes a yoke 1702 configured to engage the curtain release mechanism 1202 described above. The yoke 1702, which is similar to yoke 1212 (shown in FIGS. 12 and 13) extends from a first end 1704 of a stem 1706 which also has a second end 1708 from which a first curtain engaging piece 1710 extends. In one embodiment, a keyway 1712 is formed within the stem 1706. In a specific embodiment, the keyway 1712 is proximate the yoke 1702, substantially near the first end 1704 of the stem 1706. As shown in the illustrated embodiment, yoke 1702, stem 1706, keyway 1712 and first curtain engaging piece 1710 are formed as a single item from injection molded plastic. A second curtain engaging piece 1720 (of which only a portion is shown) is configured for snap fit engagement with first curtain engaging piece 1710 with a portion of a curtain therebetween. In one embodiment, when the first curtain engaging piece 1710 and the second curtain engaging piece 1720 are snapped together, the pieces have a shape that allows the curtain therebetween a degree of rotation with respect to the combination.

Figure 17:
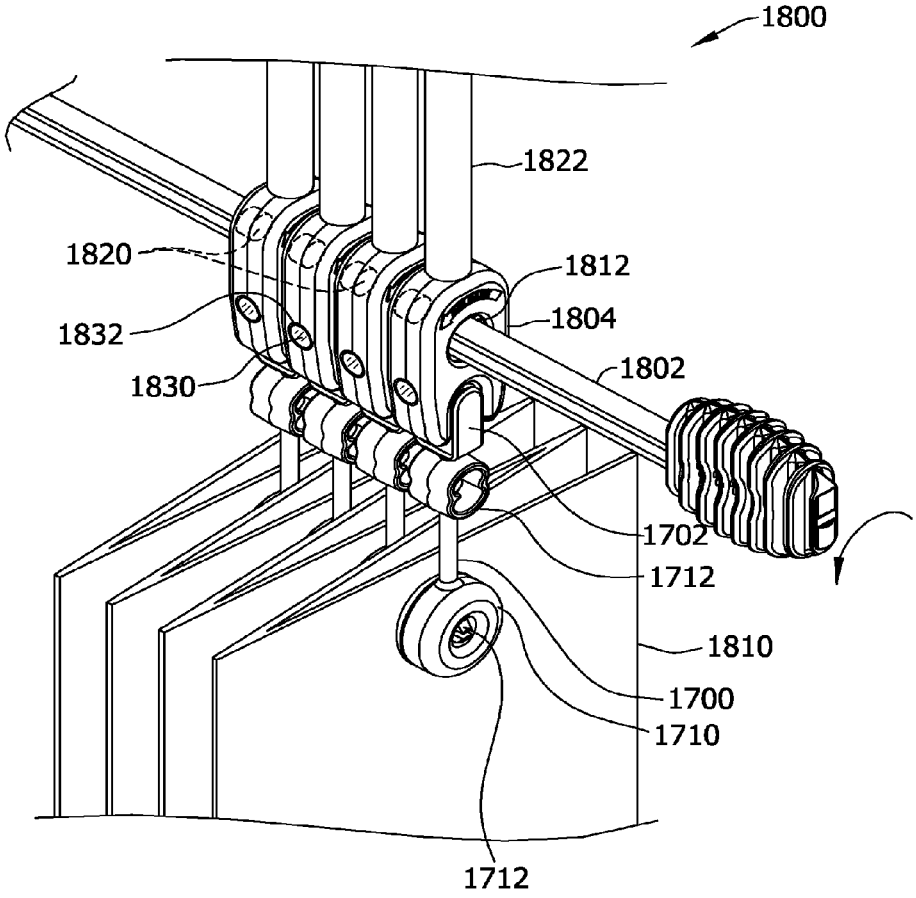
FIG. 17 is a diagram of a curtain and rod system illustrating how a key inserted through a plurality of curtain release mechanisms is utilized to release a curtain from the plurality of curtain release mechanisms.
Figure 18:
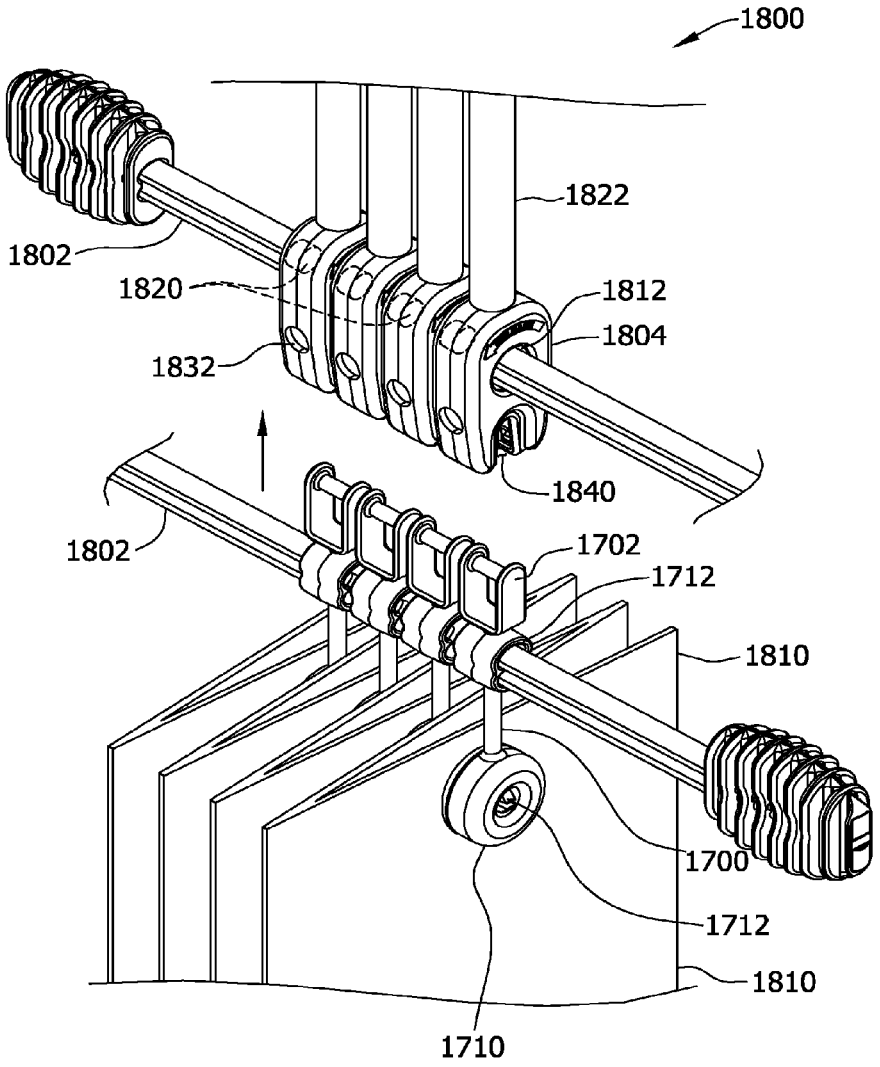
FIG. 18 is a diagram of the curtain and rod system illustrating the utilization of two keys in the attachment of a replacement curtain to a plurality of curtain rods.

As described below, by placing the keyway 1712 proximate the yoke 1712 a degree of ease is obtained when a user is installing a new curtain (and the plurality of yokes that accompany such a curtain) onto a plurality of curtain release mechanisms. More specifically, when a plurality of rod engaging members 1700 are proximate one another, a key (such as shown in FIGS. 17 and 18) may be inserted through the plurality of keyways 1712. Generally, a curtain (not shown in FIG. 16) is fabricated to include a plurality of the described rod engaging members 1700. A user may insert the key 776 through the multiple keyways 1712 of a bundled curtain to provide support when installing the multiple rod engaging members 1700 into the corresponding curtain release mechanisms 1804 (shown in FIGS. 17 and 18). By having the keyway proximate the "top" of the rod engaging members 1700, the user is able to easily, for example, wrap his thumbs around a key inserted through multiple, adjacent keyways 1712 and their fingers around a key inserted through multiple, adjacent and corresponding curtain release mechanisms 1804, to install a curtain 1810 as demonstrated in FIG. 18.

FIG. 17 is a diagram of a curtain and rod system 1800 illustrating how a key 1802 inserted through a plurality of curtain release mechanisms 1804 is utilized to release a curtain 1810 from the plurality of curtain release mechanisms 1804. The curtain and rod system 1800 illustrated in FIGS. 17 and 18 include the embodiment of rod engaging member 1700 shown in FIG. 29 attached to curtain 1810. The key 1802 is operable to engage the multiple key apertures 1812 associated with multiple curtain release mechanisms 1804 for ease in removing the curtain 1810, by simply turning key 1802. When key 1802 is turned in the proper direction, curtain 1810 and the multiple rod engaging members attached thereto, simply fall away. As described with respect to above described embodiment, magnets 1820 help to maintain the substantially adjacent orientation of curtain release mechanisms 1804 and thus the rods 1822 from which the curtain release mechanisms 1804 extend. It is noted that indicators 1830 in windows 1832 indicate that the curtain 1810 (and therefore rod engaging members 1700) is properly installed and locked in place. It is further noted that rods 1822 are shown as being circular in cross-section, though any cross-sectional shape, including those described above may be utilized.

FIG. 18 is a diagram of the curtain and rod system 1800 illustrating the above mentioned utilization of two keys 1802 (one inserted through curtain release mechanisms 1804 and the other through rod engaging members 1700) in the attachment of a replacement curtain 1810 to a plurality of curtain rods 1822. When viewing FIG. 18, it is easily understand how a user of curtain system 1800 would utilize the two keys 1802 to easily engage the slots 1840 in the curtain release mechanisms 1804 with the multiple rod engaging members 1700 to install the curtain 1810. Upon proper engagement, indicators 1830 (shown in FIG. 17) will be visible in windows 1832.

Figure 19:
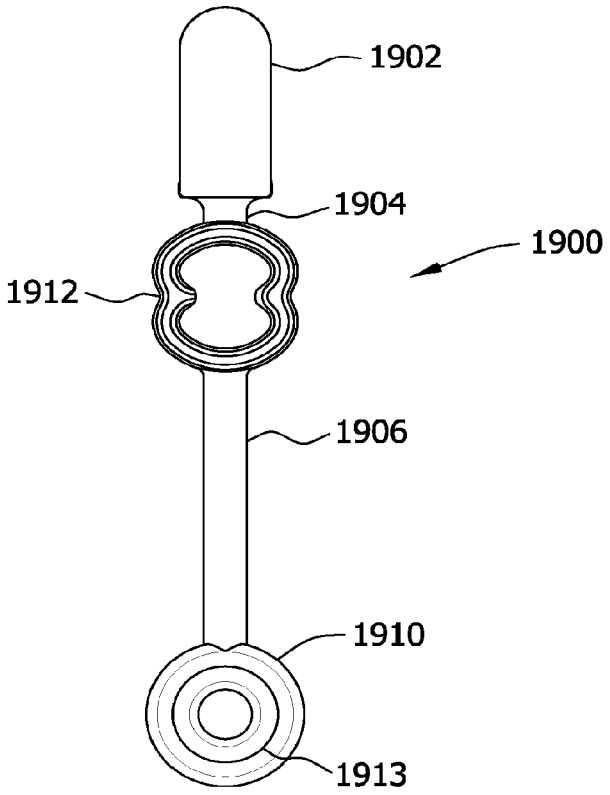
FIG. 19 is a side view of another embodiment of a rod engaging member that includes a member operable for a snap fit with a grommet disposed in a curtain.
Figure 20:
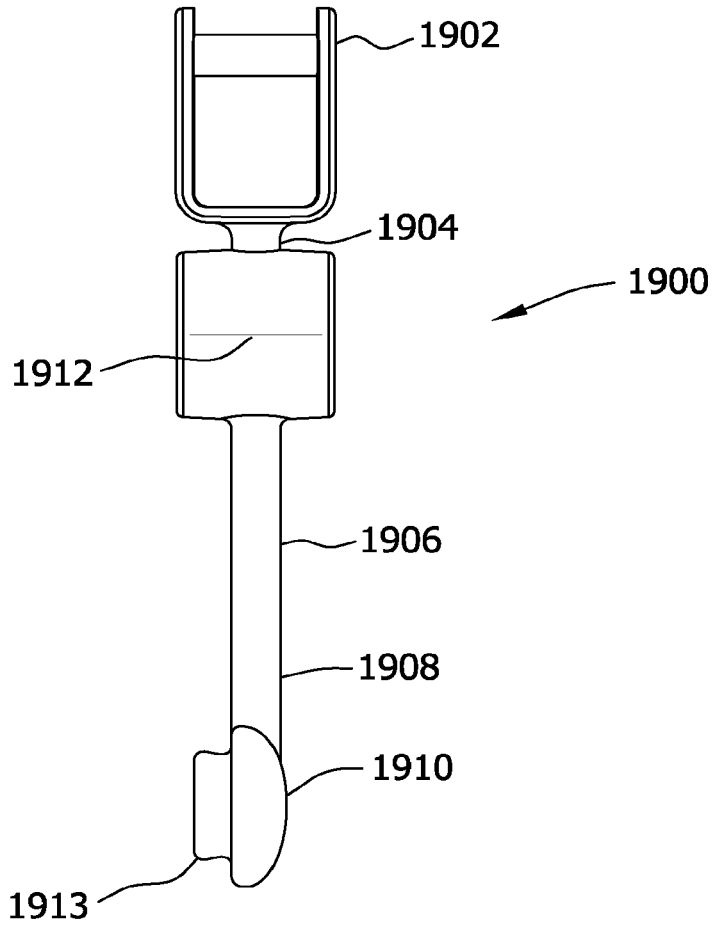
FIG. 20 is a front view of the rod engaging member of FIG. 19.
Figure 21:
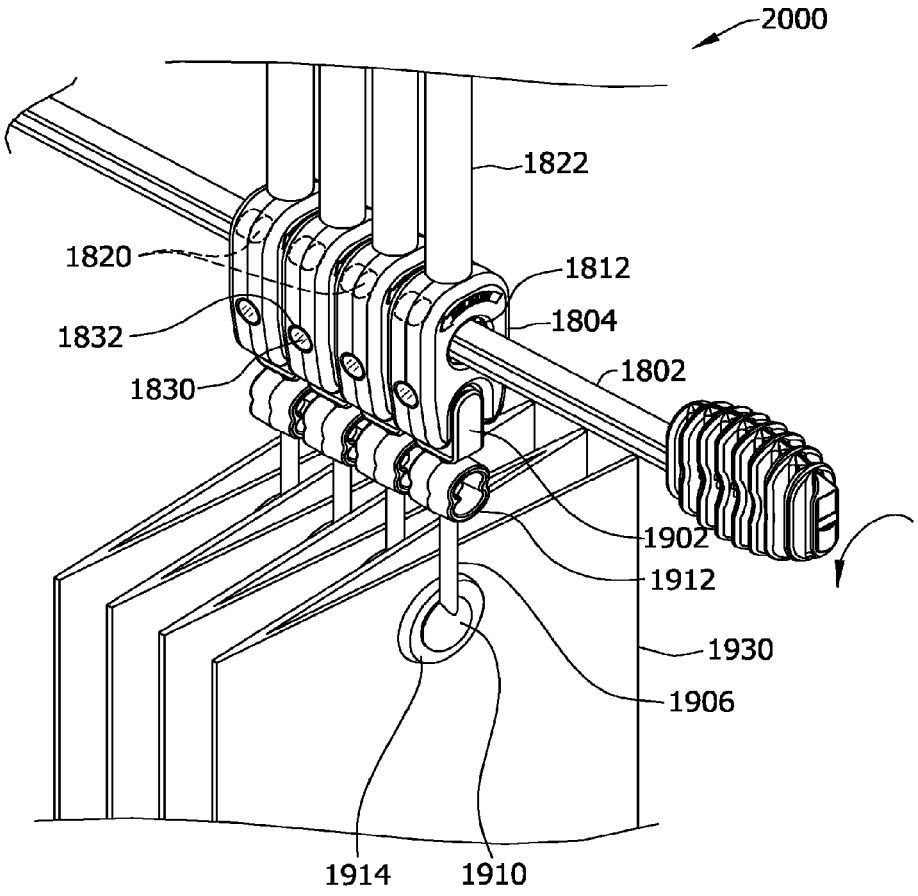
FIG. 21 is a diagram of a curtain and rod system including the rod engaging member of FIGS. 19 and 20.
Figure 22:
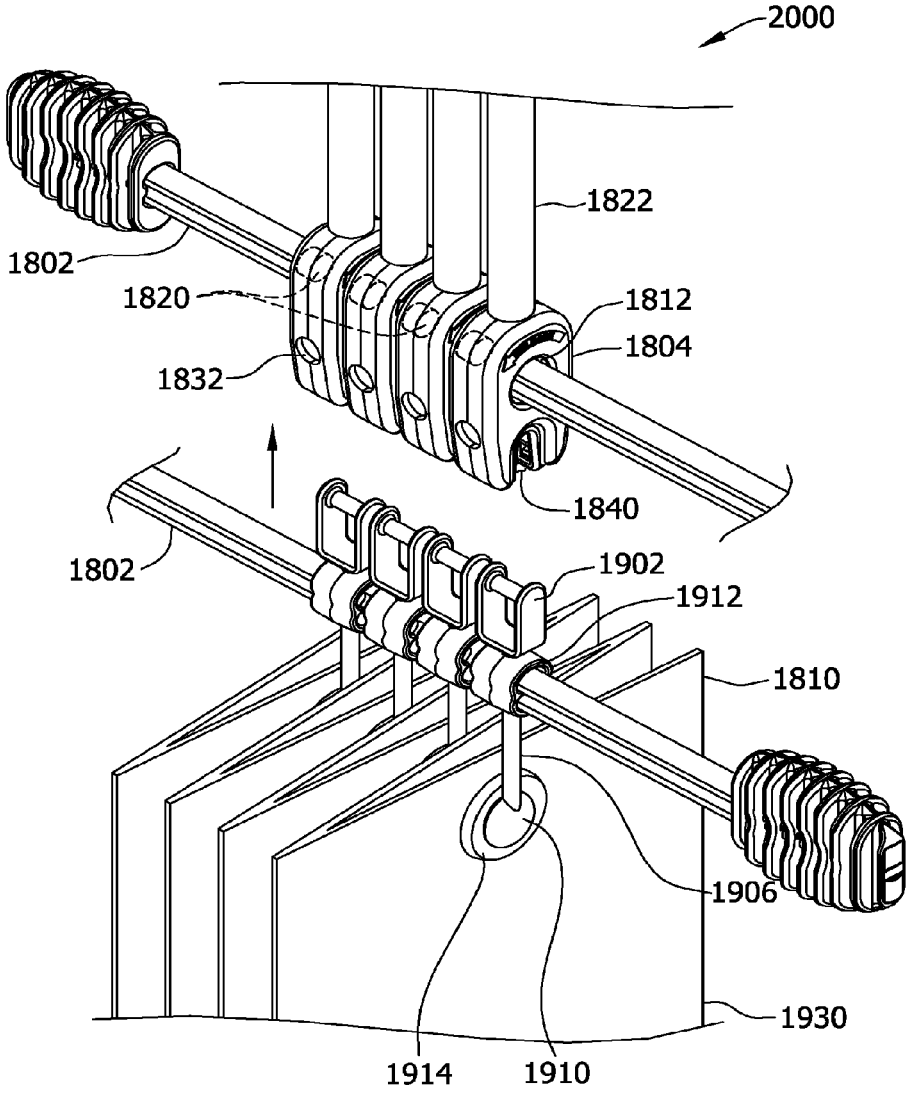
FIG. 22 is a diagram of the curtain and rod system of FIG. 21 illustrating attachment of a replacement curtain to a plurality of curtain rods.

FIG. 19 is a side view of a rod engaging member 1900 that includes a yoke 1902 configured to engage the curtain release mechanism 1202 described above. FIG. 20 is a front view of the rod engaging member 1900. The yoke 1902, which is similar to yoke 1212 (shown in FIGS. 13 and 14) extends from a first end 1904 of a stem 1906 which also has a second end 1908 from which a curtain engaging piece 1910 extends. The curtain engaging piece 1910 has a tapered cross-section and is configured for engagement with a grommet 1914 in a curtain 1930 (FIGS. 21 and 22). In one embodiment, the curtain engaging piece 1910 includes a central member 1913 that "snaps" into engagement with a grommet 1914 operably placed in the curtain 1930. This curtain 1930 is preferably a reusable curtain that is able to be laundered and/or disinfected after use and then returned to service. Accordingly, the curtain engaging piece 1910 and the grommets 1914 placed in the curtain 1930 provide for the removal (and installation) of the curtain 1930 with respect to a plurality of operably placed rod engaging members 1900.

In one embodiment, a keyway 1912 is formed within the stem 1906. In a specific embodiment, the keyway 1912 is proximate the yoke 1902, substantially near the first end 1904 of the stem 1906. As shown in the illustrated embodiment, yoke 1902, stem 1906, keyway 1912 and curtain engaging piece 1910 are formed as a single item from injection molded plastic. These features of the rod engaging member 1900 serve the same or similar purpose as those in the rod engaging member 1700 described above.

FIGS. 21 and 22 are diagrams of the curtain and rod system 2000, similar to the system 1800 described above, illustrating operation of the rod engaging member 1900 and the curtain 1930. Like elements are identified by like reference numerals.

Figure 23:
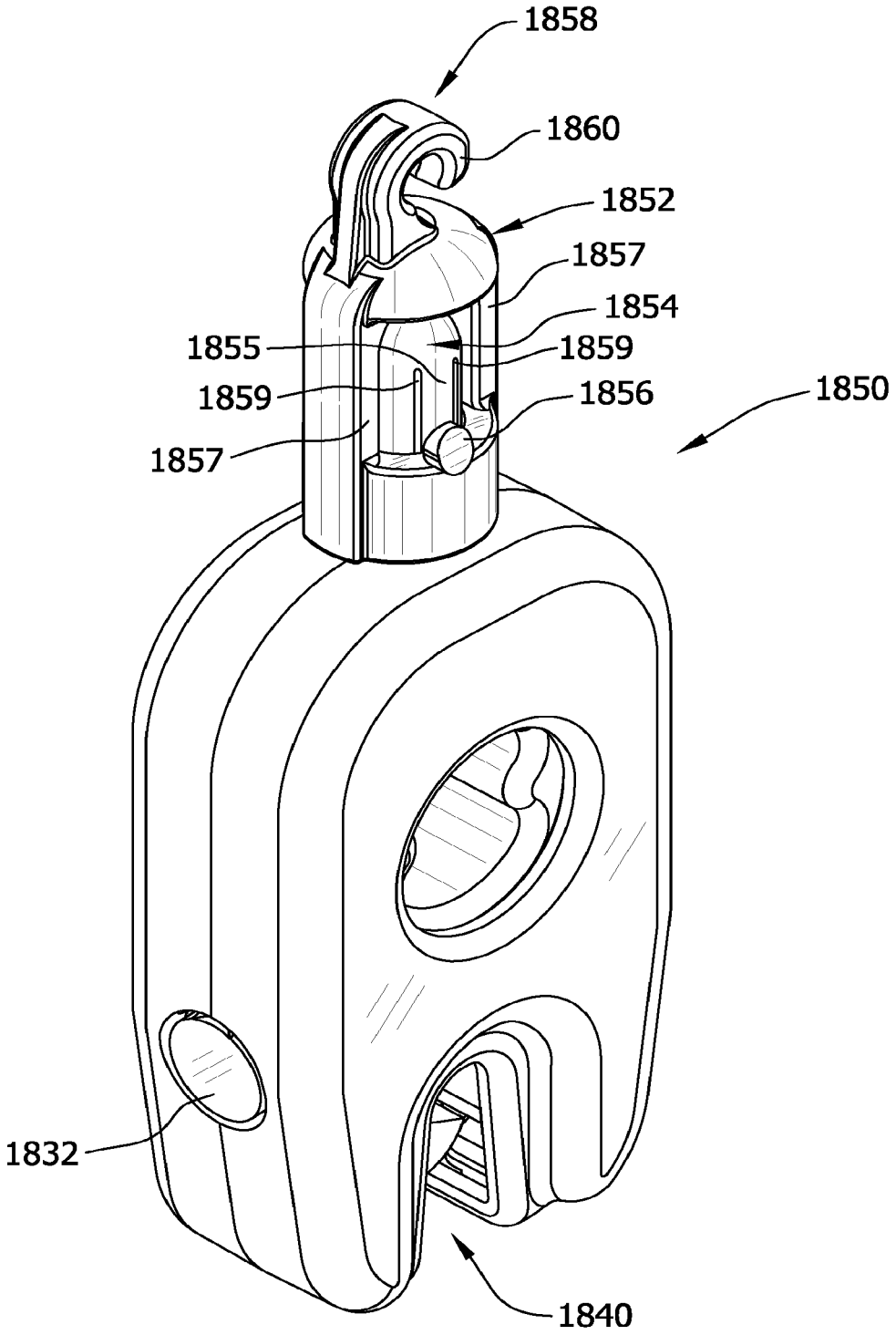
FIG. 23 is a diagram of an embodiment of a curtain release mechanism configured for engagement with a ceiling track slidable mechanism.
Figure 24:
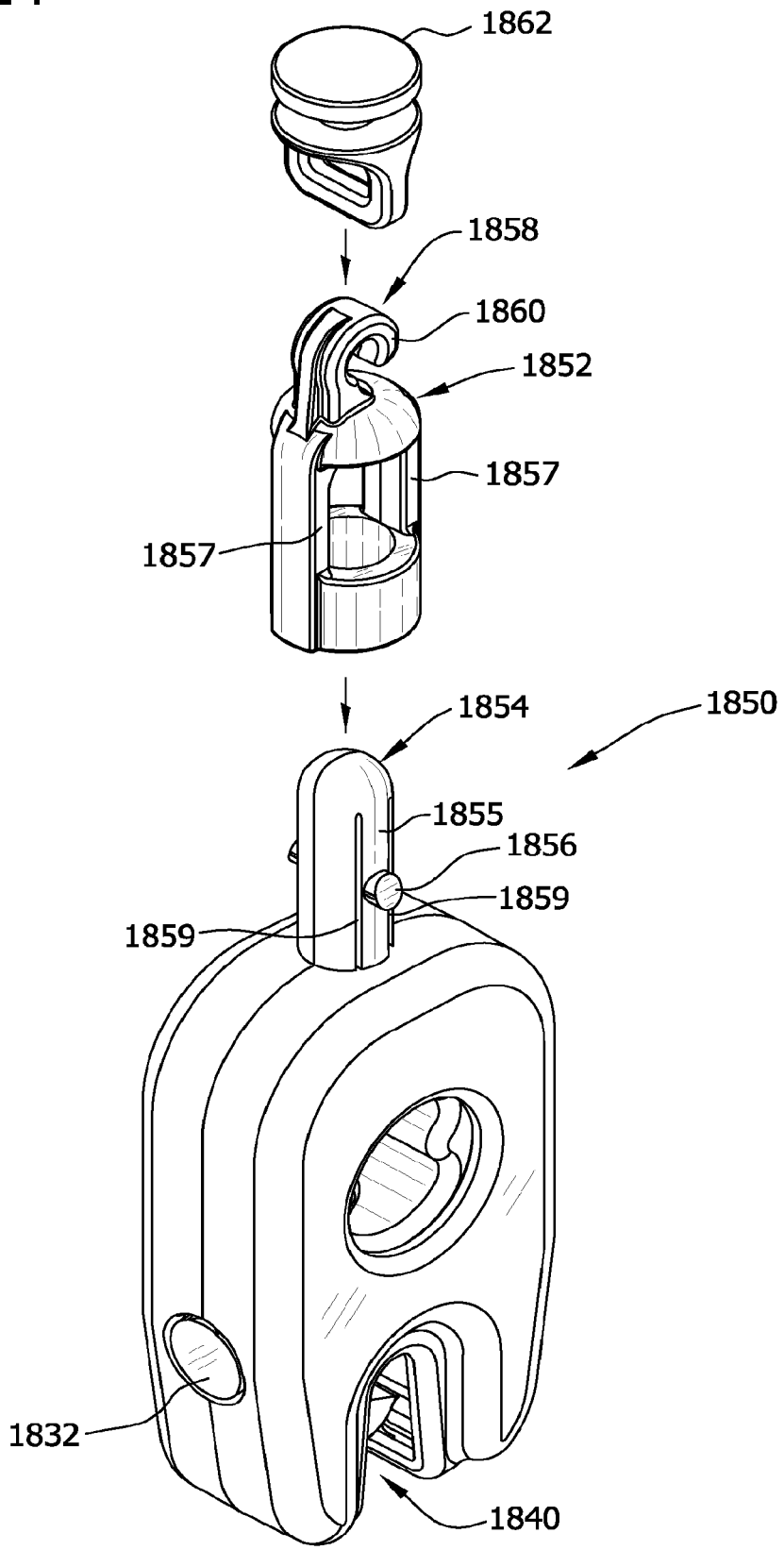
FIG. 24 is an exploded view of the curtain release mechanism of FIG. 23 including the ceiling track slidable mechanism.
Figure 25:
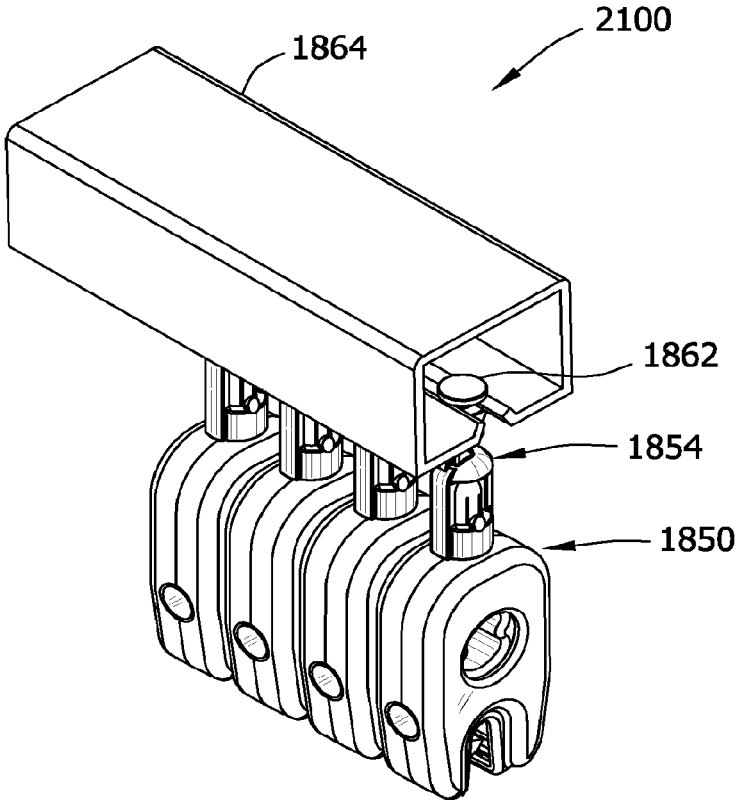
FIG. 25 illustrates the curtain release mechanism and ceiling track slidable mechanism engaged with a ceiling track member.

FIGS. 23-25 are diagrams of another embodiment of a curtain release mechanism 1850 that is similar to the curtain release mechanism 1804, and like reference numerals are used to identify like elements. The curtain release mechanism 1850 differs from the curtain release mechanism 1804 in that it has a sleeve 1852 for coupling to a ceiling track engaging member 1862 (broadly, a slidable component) (FIG. 24), instead of the curtain rods 1822 of FIG. 22. The sleeve 1852 is positioned on the curtain release mechanism 1850 opposite the slot 1840. The sleeve 1852 is disposed around a protrusion 1854 extending from the curtain release mechanism 1804. The protrusion 1854 has a pair of resilient members 1855 formed therein. The resilient members 1855 include a retention member 1856 (one of which is shown in FIG. 23) extending therefrom in a substantially perpendicular direction which retain the sleeve 1852 with respect to the protrusion 1854. Slits 1859 in the protrusion 1854 allow for the resiliency of the resilient members 1855. As such, the resilient members 1856 are compressed during assembly of the sleeve 1852 around the protrusion 1854. The retention members 1856 restrict rotation of the sleeve 1852 with respect to the protrusion 1854 to a defined arc by interference with sidewalls 1857 of the sleeve 1852.

A distal end 1858 of the sleeve 1852 disposed away from the curtain release mechanism 1804 has a hook 1860 formed therein for engagement with the track engaging member 1862. This track engaging member 1862 is configured for reception within a ceiling track 1864 (FIG. 25). The distal end 1858 may be shaped differently in other embodiments such that a track engaging member is not used. In these embodiments, the distal end 1858 engages directly with the ceiling track 1864 and is operable to slide along the ceiling track 1864.

The above described embodiments address several of the known problems related to the installation and removal of curtains that are attached to a ceiling mechanism. In one aspect, the ease of removal and installation of the curtain is increased as compared to known products. In another aspect, the described operation with respect to installation and removal reduces the exposure of personnel to any contaminants that may be embedded within such curtains.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A curtain system comprising:

a curtain body;

a plurality of curtain release mechanisms comprising a user operable mechanism configured for retention of and subsequent release of the curtain body to and from the corresponding curtain release mechanism;

a plurality of curtain engaging members attached to the curtain body, the curtain engaging members each comprising a first end and a second end, the first end operable for engagement with a respective one of the curtain release mechanisms, such that each curtain release mechanism only engages a single curtain engaging member, and the second end of each curtain engaging member is operable for attachment to the curtain body;

keyways formed in each of the plurality of curtain engaging members, wherein the keyways of the plurality of curtain engaging members are configured to be aligned; and an insertable and removable key that can be inserted through a plurality of the keyways of curtain engaging members at the same time to thereby support corresponding curtain engaging members and the curtain body on the key during installation of the curtain body and then removed after installation.

2. A curtain system for suspending a curtain, the curtain system comprising:

a plurality of curtain release mechanisms, each curtain release mechanism comprising a user operable mechanism configured for retention of and subsequent release of a curtain to and from the corresponding curtain release mechanism;

an elongate key for use in releasing the curtain from the plurality curtain release mechanisms;

wherein the user operable mechanism of each of the curtain release mechanisms is operable between a first position for coupling the curtain to the corresponding curtain release mechanism and a second position for releasing the curtain from the corresponding curtain release mechanism; and wherein the user operable mechanism of each of the curtain release mechanisms defines a keyway, and wherein the elongate key has a sufficient length such that it can be simultaneously inserted through the keyway of all of the curtain release mechanisms such that the user operable mechanisms of the curtain release mechanisms can be simultaneously operated together by the key from the first position to the second position.

3. A curtain system according to claim 2 further comprising ceiling track engaging components coupled to the curtain release mechanisms, and wherein each of the ceiling track engaging components is configured to engage a ceiling mounted track component.

4. A curtain system according to claim 2, further comprising curtain engaging members configured to be attached to the curtain for use in suspending the curtain from the curtain release mechanisms, and wherein each of the curtain engaging members defines a curtain engaging member keyway configured to receive the key such that each of the curtain engaging members can be supported together on the key.

5. A curtain system according to claim 4, wherein each of the curtain engaging members includes at least one curtain engaging piece for attaching the curtain to the corresponding curtain engaging member, and wherein the keyway of each of the curtain engaging members is defined in the corresponding at least one curtain engaging piece of each of the curtain engaging members.

6. A curtain system according to claim 2, further comprising rod engaging members configured to be coupled to the curtain release mechanisms for use in suspending the curtain body from the curtain release mechanisms.

7. A curtain system comprising:

a curtain body;

a plurality of curtain engaging members attached to the curtain body, the curtain engaging members each comprising a first end and a second end, the first end operable for engagement with a respective curtain release mechanism, the second end operable for the attachment to the curtain body;

keyways formed in each of the plurality of curtain engaging members, wherein the keyways of the plurality of curtain engaging members are configured to be aligned;

a first key that can be inserted through a plurality of the keyways of curtain engaging members at the same time to thereby support corresponding curtain engaging members and the curtain body on the first key;

wherein each curtain release mechanism comprises a user operable mechanism configured for retention of and subsequent release of the curtain to and from the corresponding curtain release mechanism;

wherein the user operable mechanism of each of the curtain release mechanisms is operable between a first position for coupling the curtain to the corresponding curtain release mechanism and a second position for releasing the curtain from the corresponding curtain release mechanism; and wherein the curtain system further comprises a second key and wherein the user operable mechanism of each of the curtain release mechanisms defines a keyway, and wherein the curtain release mechanisms can be positioned to receive the second key through the keyway of each of the curtain release mechanisms such that the user operable mechanisms of the curtain release mechanisms can be operated together by the second key from the first position to the second position.

8. A curtain system according to claim 2, further comprising curtain engaging members configured to be attached to the curtain for use in suspending the curtain from the curtain release mechanisms, and wherein each of the curtain engaging members defines a curtain engaging member keyway configured to receive a second key such that each of the curtain engaging members can be supported together on the second key.

* * * * *